US005398512A

United States Patent [19]

Inaguchi et al.

[11] Patent Number: 5,398,512

[45] Date of Patent: Mar. 21, 1995

[54] COLD ACCUMULATION TYPE REFRIGERATING MACHINE

[75] Inventors: Takashi Inaguchi; Masashi Nagao; Hideto Yoshimura; Mitsuhiro Kishida, all of Amagasaki; Kazuki Moritsu, Ako; Takahiro Matsumoto, Ako; Shuuichi Nakagawa, Ako; Shuji Ando, Ako, all of Japan

[73] Assignee: Mitsubishi Denki Kabushiki Kaisha, Tokyo, Japan

[21] Appl. No.: 118,717

[22] Filed: Sep. 10, 1993

[30] Foreign Application Priority Data

Sep. 17, 1992 [JP] Japan ..... 4-247512

[51] Int. Cl.[6] ..... F25B 9/00

[52] U.S. Cl. ..... 62/6; 62/228.1; 60/520

[58] Field of Search ..... 62/6, 228.1; 60/520

[56] References Cited

U.S. PATENT DOCUMENTS

| | | | |
|---|---|---|---|
| 4,397,155 | 8/1983 | Davey | 62/6 |
| 4,543,793 | 10/1985 | Chellis et al. | 62/228.1 |
| 4,724,676 | 2/1988 | Lewis | 62/6 |
| 4,879,876 | 11/1989 | Robertson | 62/6 |
| 4,969,333 | 11/1990 | Osawa et al. | 62/6 |
| 5,009,072 | 4/1991 | Nagao . | |
| 5,018,357 | 5/1981 | Livingstone et al. | 62/228.1 |
| 5,032,772 | 7/1991 | Gully et al. | 62/228.4 |
| 5,154,063 | 10/1992 | Nagao et al. . | |

FOREIGN PATENT DOCUMENTS 46-10255 3/1971 Japan .

*Primary Examiner*—Ronald C. Capossela

*Attorney, Agent, or Firm*—Oblon, Spivak, McClelland, Maier, & Neustadt

[57] ABSTRACT

A cold accumulation type refrigerating machine having a high refrigeration efficiency. Rotation output of a stepping motor is converted to a reciprocative motion of a displacement member carrying a cold accumulator and disposed within a cylinder in which first and second closed chambers are defined above and below the displacement member, respectively. A compressed gas discharged from a compressor is introduced into the second closed chamber through the cold accumulator upon opening of a suction valve and undergoes expansion within the second closed chamber, the gas being then fed back to the compressor through the cold accumulator upon opening of an discharge valve, whereupon one cycle of refrigerating operation is completed. Rotation speed of the stepping motor is varied during every one cycle of operation by means of a pulse oscillation controller such that a time taken for the displacement member to reach a top dead center position from a time point at which the discharge valve is opened is increased while the remaining period of the one cycle is correspondingly shortened.

19 Claims, 23 Drawing Sheets

COLD ACCUMULATION TYPE REFRIGERATING MACHINE

BACKGROUND OF THE INVENTION

1. Field of the invention

The present invention generally relates to a cold accumulation type refrigerating machine which may also be referred to as the regenerative refrigerator and which is equipped with a regenerative heat exchanger also known as the cold accumulator or holdover. More particularly, the invention is concerned with the cold accumulation type refrigerating machine which exhibits high refrigeration performance and efficiency owing to enhanced heat exchange efficiency of the cold accumulator or holdover.

2. Description of the Related Art

For having a better understanding of the invention, the technical background thereof will first be described in some detail. FIG. 18 is a diagram showing schematically a structure of the cold accumulation type refrigerating machine (regenerative refrigerator) which is known heretofore in the art, as is disclosed, for example, in Japanese Patent Publication No. 10255/1971. Referring to the figure, the refrigerating machine includes as major components an electric motor 21 serving as a prime mover of the refrigerator, a gas compressor 4 and a gas expansion/refrigeration assembly which is comprised of a cylinder 13 and a displacement member 14. Connected operatively to a rotatable output shaft of the motor 21 is a sort of crank mechanism for translating the rotation of the motor 21 into a linear reciprocative motion of the displacement member 14 within the cylinder 13. To this end, the crank mechanism is composed of a rotatable disk 10A operatively coupled to the output shaft of the motor 21, a rotatable cam roll 10 mounted on the disk 10A at a radial position eccentric to the center of the disk 10A and rotatable within a rectangular frame 10C which is connected to the displacement member 14 through a piston rod 12. It will readily be appreciated that the rotation output of the motor 21 is translated into the linear reciprocative motion of the displacement member 14 within the cylinder 13 through the crank mechanism mentioned above. The displacement member 14 incorporates and carries a cold accumulator (holdover) 15, i.e., a sort of heat exchanger, which may be comprised of a mesh of phosphor bronze or lead balls for storing or holding over the cold. A hermetically closed top chamber 16 is defined between the inner surface of the top wall of the cylinder 13 and the top surface of the displacement member 14, while a hermetically closed bottom chamber 17 which serves as a gas expansion chamber is defined between the inner surface of a bottom wall 20 of the cylinder 13 and the bottom surface of the displacement member 14. The closed top chamber 16 and the bottom expansion chamber 17 are isolated from each other by means of a seal member 18 disposed fluid-tightly between the inner wall of the cylinder 13 and a peripheral surface of the displacement member 14 in the vicinity of the top end thereof. This seal 18 is secured to the displacement member 14 so as to be movable together with the latter. The closed top chamber 16 is in fluid communication with the cold accumulator 15 through a passage **14*a*, and the expansion chamber 17 is also communicated to the cold accumulator 15 via a passage 14*b*. Thus, it can be said that the top and bottom chambers 16 and 17 are in fluid communication with each other through the passage 14*a*, the cold accumulator 15 and the passage 14*b*. It is further to be mentioned that a seal member 19 is disposed fluid-tightly around the piston rod 12 so as to hermetically close the interior of the cylinder 13 from the atmosphere. Extending from the top chamber 16 of the expansion/refrigeration assembly is a pipe 5 which is bifurcated into a branch pipe 5A connected to an inlet port of the gas compressor 4 and a branch pipe 5B connected to a discharge port of the compressor 4. A gas suction (feed) valve 7 is installed in the branch pipe 5B while a gas discharge (feedback) valve 9 is installed in the branch pipe 5A. Closing and opening of these valves 7 and 9 are controlled under respective predetermined timings, as described hereinafter, by means of actuator cams 6 and 8 which are also operatively coupled to the output shaft of the motor 21. The bottom wall 20 of the cylinder 13** constitutes a heat conducting portion from which the cold is emitted.

Next, description will be directed to the operation of the refrigerating machine of the structure described above. A gas such as a helium gas discharged at a high pressure from the compressor 4 after having undergone compression therein flows into the hermetically closed top chamber 16 defined within the cylinder 13 via the pipes 5B and 5 when the suction valve 7 is opened by the actuator cam 6. The gas within the top chamber 16 is introduced into the cold accumulator 15 through the gas passage **14*a* to be cooled by the cold stored in the cold accumulator 15 in the preceding cycle. The gas thus cooled flows into the bottom or expansion chamber 17 through the gas passage 14*b*. At this time, the seal 19 prevents the gas from leaking exteriorly of the cylinder 13. Further, because of the presence of the seal 18, the gas is inhibited from flowing into the top chamber 16 from the bottom chamber 17 through the gap formed between the cylinder 13 and the displacement member 14. Upon reaching the closed bottom chamber 17, the gas is expanded to generate cold since the displacement member 14 moves upwardly, as a result of which articles to be cooled (not shown) are refrigerated through the heat conducting wall 20**.

The gas expanded and depressurized within the bottom expansion chamber 17 is caused to pass through the gas passage **14*b* and flow again through the cold accumulator 15 in the backward direction as the displacement member 14 moves downwardly, as a result of which the cold accumulator 15 is cooled by the gas through heat exchange therewith, whereby the cold is stored in the cold accumulator 15. The gas heated as a result of the regenerative heat exchange mentioned above then flows into the closed top chamber 16 via the gas passage 14*a*. At that time point, the discharge valve 9 interlocked with the actuator cam 8 is opened with the suction valve 7 being closed. Consequently, the gas within the closed top chamber 16 is fed back to the compressor 4** to be compressed again. The operation described so far constitutes one cycle of refrigerating operation, which is successively repeated.

Next, description will be made of the correspondence relation among the position of the displacement member 14, the open/close timings of the valves 7 and 9 and change in the pressure within the bottom expansion chamber 17 by reference to FIG. 19 along with FIG. 18.

Referring to FIG. 18, the rotation output of the motor 21 is translated into the reciprocative motion of the displacement member 14 through the crank mechanism, as described previously, whereby the displacement member 14 is caused to repetitively move upwardly and downwardly within the cylinder 13, as is illustrated in FIG. 19(*a*). Parenthetically, in FIG. 19, phase angles are taken along the abscissa such that a phase angle is 0° when the displacement member 14 is at the bottom dead center (BDC) while the phase angle assumes 180° at the top dead center (TDC) of the displacement member 14, and one cycle of operation is completed at a phase angle of 360°. It should further be mentioned that operations of the actuator cams 6 and 8 are interlinked to the rotation of the output shaft of the motor 21 such that the suction valve 7 is opened at a phase angle of −30° and closed at a phase angle of 120°, as shown in FIG. 19(*b*), while the discharge valve 9 is opened at a phase angle of 150° and closed at 330°, as illustrated at in FIG. 19(*c*). The pressure within the closed bottom chamber 17 changes in response to the open/close operation of the suction valve 7 and the discharge valve 9 as well as the displacement of the piston-like member 14. More specifically, from the moment when the suction valve 7 is opened at the phase angle of −30°, the pressure within the closed bottom chamber 17 increases while it decreases from the moment when the discharge valve 9 is opened at the phase angle of 150°.

In the meanwhile, the rotation speed of the output shaft of the motor 21 remains constant or uniform throughout the operation cycle. Accordingly, the time taken for the phase to advance by 1° is equal to a quotient obtained by dividing the time taken for the one operation cycle by 360. Assuming, by way of example, that the time of one cycle is one second, the displacement member 14 is forced to move in such a manner as illustrated in FIG. 20 in which the origin represents the bottom dead center. On the other hand, the pressure within the bottom expansion chamber 17 changes in such a manner as illustrated in FIG. 21.

In the cold accumulation type refrigerating machine known heretofore and implemented in the Structure described above, the rotation speed (rpm) of the motor 21 is maintained constant. Consequently, the mass flow rate of the gas passing through the regenerative heat exchanger or cold accumulator 15 becomes maximum at the moment when the discharge valve 9 is opened. FIG. 22 is a view for graphically illustrating the mass flow rate of the gas entering the closed bottom chamber 17 after passing through the cold accumulator 15 when the temperature of the heat conducting wall 20 is at 50 K. Parenthetically, the graph of FIG. 22 is plotted on the assumption that the gas flow rate o takes a positive value when the gas enters the bottom expansion chamber 17. The efficiency of the cold accumulator or regenerative heat exchanger 15 becomes lowest at the moment when the discharge valve 9 is opened (corresponding to the time point of 0.5 sec. in FIG. 22). In this conjunction, it is noted that the cold accumulator or regenerative heat exchanger 15 is ordinarily designed on the basis of a mean gas flow rate over one cycle. Consequently, when the actual gas flow rate is deviated significantly from the designed or indicated mean gas flow rate, it becomes impossible to realize the indicated efficiency of the cold accumulator 15, which in turn means that the refrigeration efficiency of the refrigerating machine is eventually degraded, giving rise to a problem.

FIG. 23 is a view graphically illustrating a change in the mass flow rate of the coolant gas flowing into the bottom expansion chamber 17 via the cold accumulator 15 when the temperature of the heat conducting wall 20 is at 4.2 K. In this case, the coolant or helium gas may be regarded as being essentially not in the compressed state. Consequently, at the moment when the discharge valve 9 is opened, the gas flow rate does not undergo any appreciable change. Rather, the gas flow rate increases as the speed of the displacement member 14 becomes higher. Moreover, it is noted that the maximum flow rate of the gas flowing into the bottom expansion chamber 17 is high as compared with the gas flow expelled from that chamber 17. In any case, the gas flow rate deviates from the mean value, providing obstacle in realizing the indicated or designed efficiency of the heat exchanger constituting the cold accumulator, whereby the efficiency of the refrigerating machine is also degraded, to a disadvantage.

SUMMARY OF THE INVENTION

In the light of the state of the art described above, it is an object of the present invention to provide a cold accumulation type (or regeneration type) refrigerating machine which is essentially immune to the problems of the refrigerator known heretofore and which can enjoy an enhanced efficiency of the regenerative heat exchanger or cold accumulator and hence an improved refrigeration efficiency.

In view of the above and other objects which will become apparent as description proceeds, the present invention is directed to a cold accumulation type refrigerating machine which comprises an electric motor having a rotatable output shaft, a means for converting rotation of the motor output shaft into a linear reciprocative motion of a displacement member disposed within a stationary cylinder, a hermetically closed expansion chamber (e.g., bottom chamber) defined within the cylinder and having a volume variable as the displacement member moves reciprocatively, and a gas compressor having an outlet port communicated to the expansion chamber through a first valve (suction valve) and a cold accumulator (e.g., regenerative heat exchanger) for feeding a compressed gas discharged from the gas compressor to the expansion chamber through the cold accumulator when the first valve is opened, the gas being caused to expand within the expansion chamber, the gas compressor having a second valve (discharge valve) communicated to the expansion chamber so that the gas undergone the expansion within the expansion chamber is fed back to the gas compressor through the cold accumulator when the second valve is opened, wherein feeding of the compressed gas into the expansion chamber, expansion thereof within the expansion chamber and feeding back of the gas to the compressor after expansion constitute one cycle of operation of the refrigerating machine.

In the cold accumulation type (regeneration type) refrigerating machine of the structure described above, there is provided according to an aspect of the present invention a control means for changing the rotation speed of the electric motor so that flow rate of the gas flowing through the cold accumulator remains substantially uniform throughout the one cycle of operation.

In a preferred mode for carrying out the invention, the electric motor may be constituted by a stepping motor, wherein the control means for changing the rotation speed of the motor during the one cycle of operation may include a pulse oscillation controller for changing rotation speed of the stepping motor by controlling correspondingly a pulse frequency or pulse interval of a pulse voltage applied to the stepping motor.

By constituting the motor by a stepping motor and using a pulse oscillation control which is known per se, control of the rotation speed of the motor can be much facilitated.

In another preferred mode for carrying out the invention, the control means may be so implemented as to control the rotation speed of the electric motor such that the rotation speed of the motor is lowered during a period extending from a time point at which the second valve (discharge valve) is opened to a time point at which the displacement member reaches a top dead center thereof while the rotation speed is increased during the remaining period in the one cycle of operation.

In a further preferred mode for realizing the refrigerating machine according to the invention, the rotation speed of the motor means may be so controlled that a time taken for the displacement member to reach a top dead center point from a time point at which the second valve is opened is increased by a factor of two when compared with a corresponding time taken by the displacement member on the assumption that the motor means is rotated at a uniform speed, the remaining time in the one cycle being correspondingly shortened.

With the arrangement of the refrigerating machine described above, change in the mass flow rate of the gas at the moment when the discharge valve is opened is reduced by a half when compared with the known refrigerating machine, whereby the gas flow rate is smoothed or uniformed as a whole. As a result, the efficiency of the cold accumulator can be enhanced by a factor of about two, being accompanied with a corresponding improvement in the efficiency of the refrigerating machine.

In the cold accumulation type refrigerating machine according to the invention, the expansion/refrigeration assembly may be implemented in a two-stage structure which includes a second cylinder having a smaller volume than that of the cylinder mentioned above and disposed below the latter, a second displacement member disposed within the second cylinder so as to move reciprocatively therein and incorporates a second cold accumulator together with gas passages and communicated to the cold accumulator, a second expansion chamber defined between the second displacement member and the cylinder, a second seal provided to isolate the expansion chamber and the second expansion chamber from each other and a heat conducting wall constituted by a bottom wall of the second cylinder.

Further, the expansion/refrigeration assembly may additionally include a third cylinder disposed below the second cylinder and having a smaller volume than that of the second cylinder, a third displacement member disposed to move reciprocatively within the third cylinder, a third cold accumulator having gas passages and communicated thereto, a third expansion chamber enclosed and defined by the third displacement member and the third cylinder, and a seal for isolating the second expansion chamber from the third closed chamber.

According to another aspect of the invention, there is provided for the cold accumulation type refrigerating machine mentioned hereinbefore a control means for controlling the electric motor such that the second valve (discharge valve) is opened substantially at a same time point at which the displacement member reaches a top dead center and that the rotation speed of the motor is lowered during a predetermined period close to the time point at which the displacement member reaches the top dead center.

In a preferred mode for realizing the control means mentioned above, the predetermined period may be so selected as to correspond to a coverage of 30° in phase angle when the one cycle is represented in terms of phase angle of 360°.

With the control of the rotation speed of the motor mentioned above, loss in the indicated work can be reduced with the efficiency of the refrigerating machine being enhanced. Further, by decreasing the motor rotation speed in the vicinity of the top dead center of the displacement member, the second or discharge valve is opened slowly, whereby remarkable change in the gas flow rate which may occur when the discharge valve is opened speedily can be suppressed.

According to still another aspect of the invention, there is provided for the cold accumulation type refrigerating machine mentioned previously a control means for controlling the electric motor such that time points at which the first valve (suction valve) and the second valve (discharge valve) are opened, respectively, are so set as to substantially coincide with a time point at which the displacement member reaches a top dead center and that the rotation speed of the motor is lowered during a predetermined period close to the time point at which the displacement member reaches the top dead center.

In this case, the predetermined period may also be so selected as to correspond to a coverage of 30° in phase angle when the one cycle is represented in terms of phase angle of 360°.

With the arrangements described above, loss in the indicated work can be reduced with the efficiency of the refrigerating machine being enhanced. Further, by decreasing the motor rotation speed in the vicinity of the top dead center of the displacement member, the second or discharge valve is opened slowly, whereby remarkable change in the gas flow rate which may occur when the discharge valve is opened speedily can be suppressed.

According to yet another aspect of the invention, there is provided for the cold accumulation type refrigerating machine mentioned previously a control means for controlling the rotation speed of the electric motor such that the displacement member moves linearly at a uniform speed from a top dead center thereof to a bottom dead center.

According to a further aspect of the invention, there is provided for the cold accumulation type refrigerating machine mentioned previously a control means for controlling the rotation speed of the electric motor such that the displacement member moves linearly at a uniform speed from a bottom dead center thereof to a top dead center.

According to a still further aspect of the invention, there is provided for the cold accumulation type refrigerating machine a control means for controlling the rotation speed of the electric motor such that a time taken for the displacement member to move from a bottom dead center to a top dead center is longer than a time taken for the displacement member to move from a top dead center thereof to a bottom dead center.

With the arrangement described above, change in the mass flow rate of the gas at the moment when the discharge valve is opened is reduced when compared with the known refrigerating machine, whereby the gas flow rate is smoothed or uniformed as a whole. As a result, the efficiency of the cold accumulator can be enhanced, being accompanied with a corresponding increase in the efficiency of the refrigerating machine.

According to a yet further aspect of the invention, there is provided a cold accumulation type refrigerating machine which comprises an electric motor having a rotatable output shaft, a means for converting rotation of the output shaft into linear reciprocative motion of a displacement member disposed within a stationary cylinder, a hermetically closed expansion chamber defined within the cylinder and having a volume variable as the displacement member moves reciprocatively, a gas compressor having an outlet port communicated to the expansion chamber through a first valve (suction valve) and a cold accumulator for feeding a compressed gas discharged from the gas compressor to the expansion chamber through the cold accumulator when the first valve is opened, the gas being caused to expand within the closed chamber, the gas compressor having a second valve (discharge) communicated to the closed chamber so that the gas undergone the expansion within the closed chamber is fed back to the gas compressor through the cold accumulator when the second valve is opened, wherein feeding of the compressed gas to the expansion chamber, expansion thereof within the closed chamber and feeding back of the gas to the compressor after expansion constitute one cycle of operation of the refrigerating machine, a temperature sensor means for detecting a temperature of a heat conducting wall provided at a bottom wall of the cylinder, and a control means for changing rotation speed of the electric motor during the one cycle of operation in dependence on temperature level of the heat conducting wall detected by the temperature sensor means.

The refrigerating machine of the structure described above can be operated with a motor rotation speed most suited for the temperature detected at the heat conducting member.

According to another aspect of the invention, there is provided a cold accumulation type refrigerating machine which comprises an electric motor having a rotatable output shaft, a means for converting rotation of the output shaft into linear reciprocative motion of a displacement member disposed within a stationary cylinder, a hermetically closed expansion chamber defined within the cylinder and having a volume variable as the displacement member moves reciprocatively, a gas compressor having an outlet port communicated to the closed chamber through a first valve (suction valve) and a cold accumulator for feeding a compressed gas discharged from the gas compressor to the expansion chamber through the cold accumulator when the first valve is opened, the gas being caused to expand within the closed chamber, a second valve (discharge valve) communicated to the expansion chamber so that the gas undergone the expansion within the closed chamber is fed back to the gas compressor through the cold accumulator when the second valve is opened, wherein feeding of the compressed gas to the closed chamber, expansion thereof within the closed chamber and feeding back of the gas to the compressor after expansion constitute one cycle of operation of the refrigerating machine, a pressure sensor means for measuring a pressure within the cylinder, a temperature sensor means for detecting a temperature of a heat conducting wall provided at a bottom end of the cylinder, and a control means for determining arithmetically a rate of the gas flow into the closed chamber on the basis of outputs of the pressure sensor and the temperature sensor to thereby change the rotation speed of the electric motor during the one cycle of operation so that the gas flow rate remains substantially uniform over the one cycle of operation.

With the structure of the refrigerating machine described above, the rotation speed of the motor can be so controlled that the machine operates with a high efficiency by taking into account the pressure and temperature sensor information in the control.

The above and other objects, features and attendant advantages of the present invention will more easily be understood upon reading the following description of the preferred embodiments thereof taken, only by way of example, in conjunction with the drawings.

DESCRIPTION OF THE PREFERRED EMBODIMENTS

Now, the present invention will be described in detail in conjunction with preferred or exemplary embodiments thereof by reference to the drawings.

Embodiment 1

Figure 1:
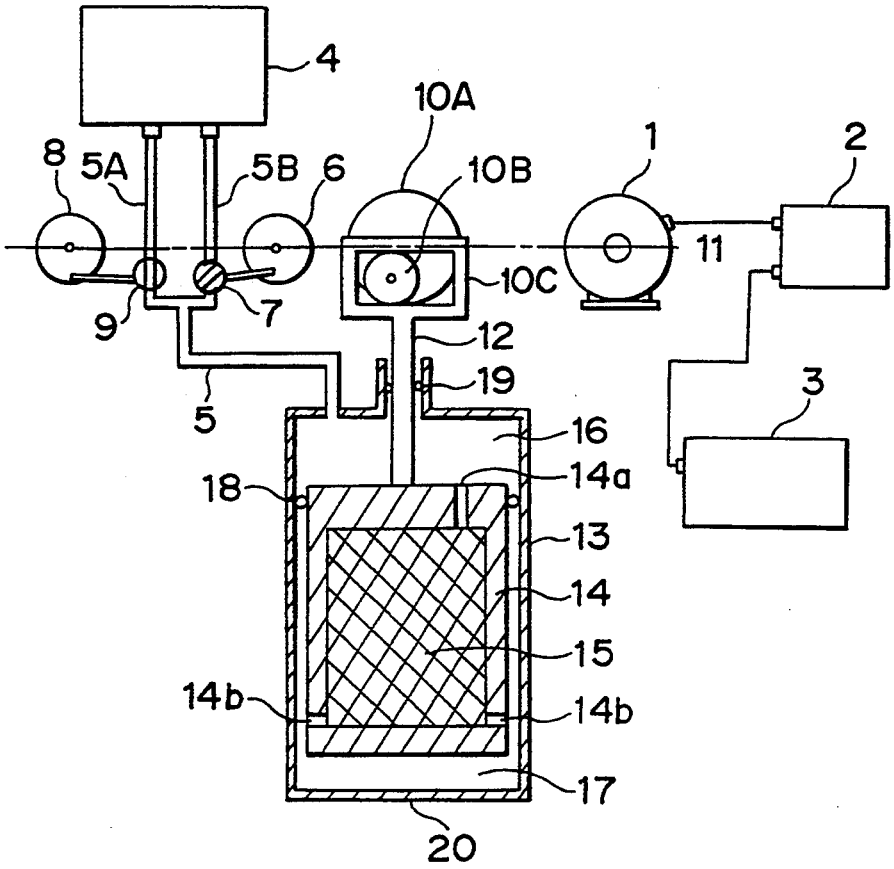
FIG. 1 is a diagram showing a structure of a cold accumulation type refrigerating machine according to a first embodiment of the present invention.
Figure 18:
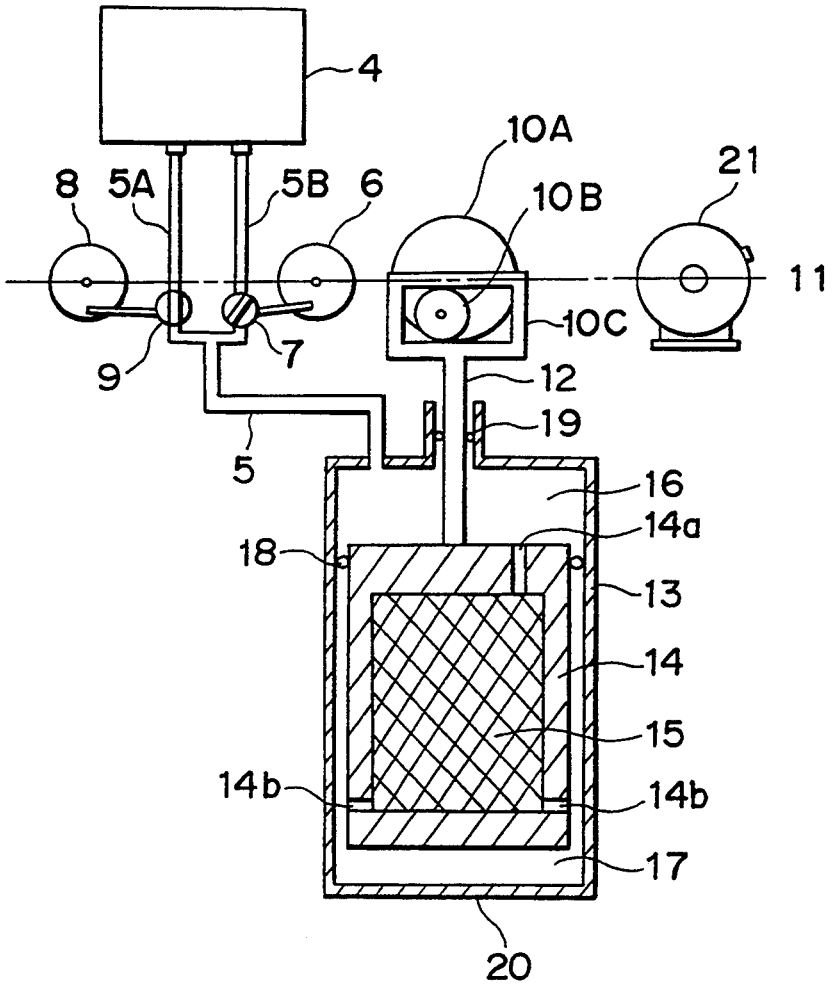
FIG. 18 shows a cold accumulation type refrigerating machine known heretofore.
Figure 19A:
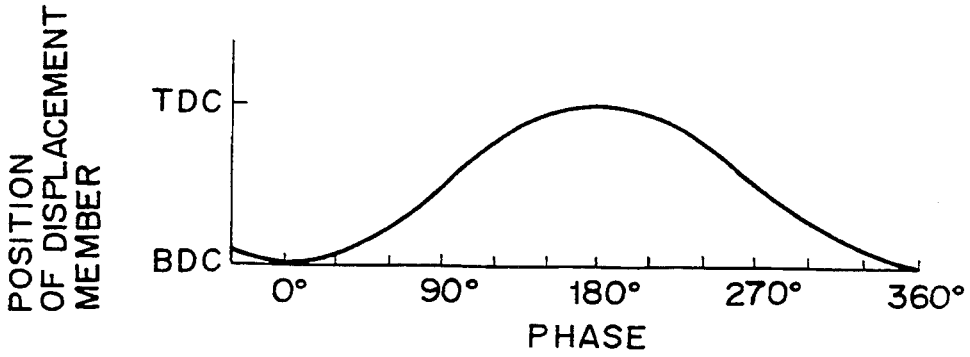
FIGS. 19(*a*), 19(*b*), 19(*c*) and 19(*d*) illustrate a timing chart showing a correspondence relation among the position of the displacement member, openings of the suction valve and the discharge valve and pressure variations within the gas expansion chamber in the refrigerator shown in FIG. 18.
Figure 19B:
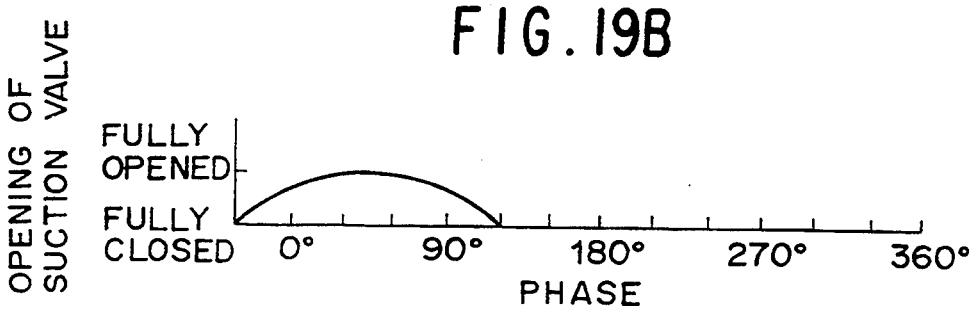
Figure 19C:
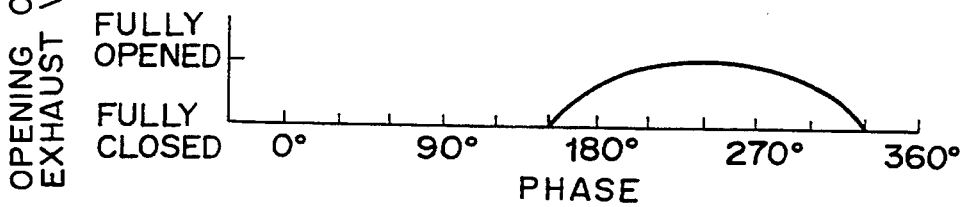
Figure 19D:
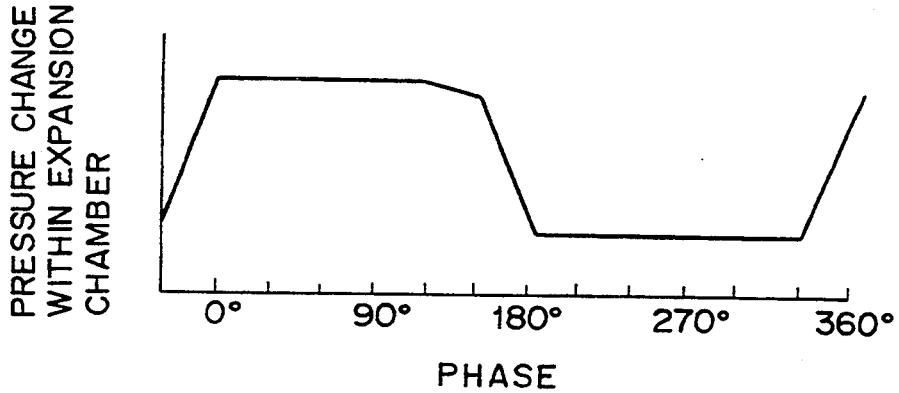
Figure 20:
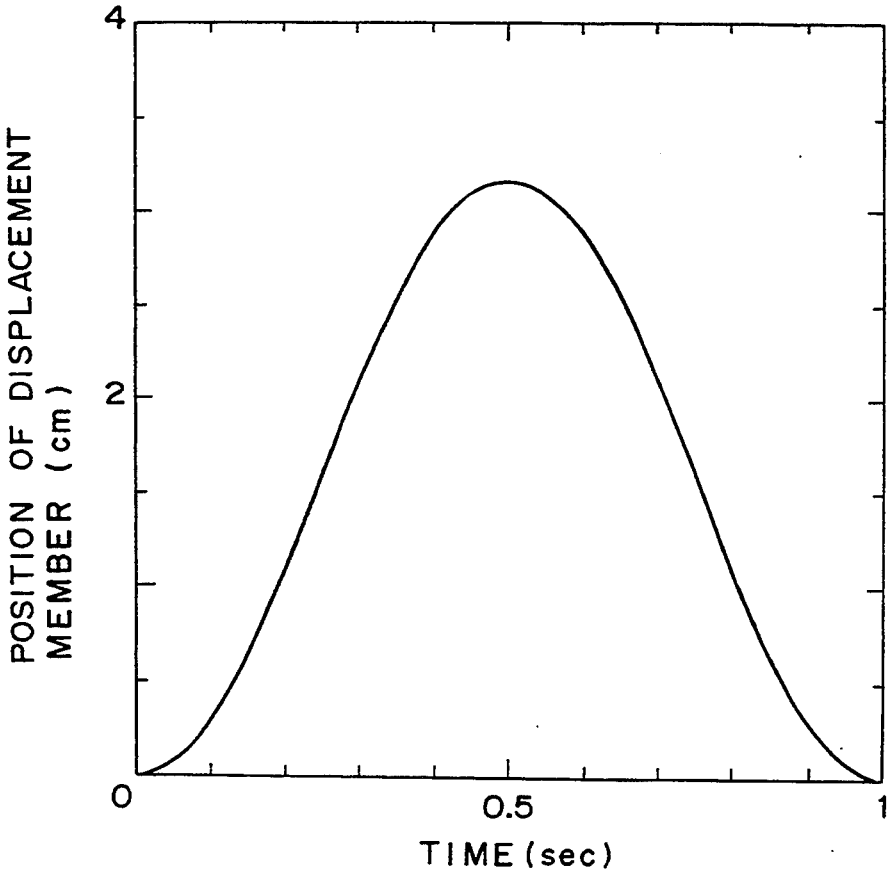
FIG. 20 is a view for graphically illustrating positions of the displacement member as a function of time in the refrigerating machine shown in FIG. 18.
Figure 21:
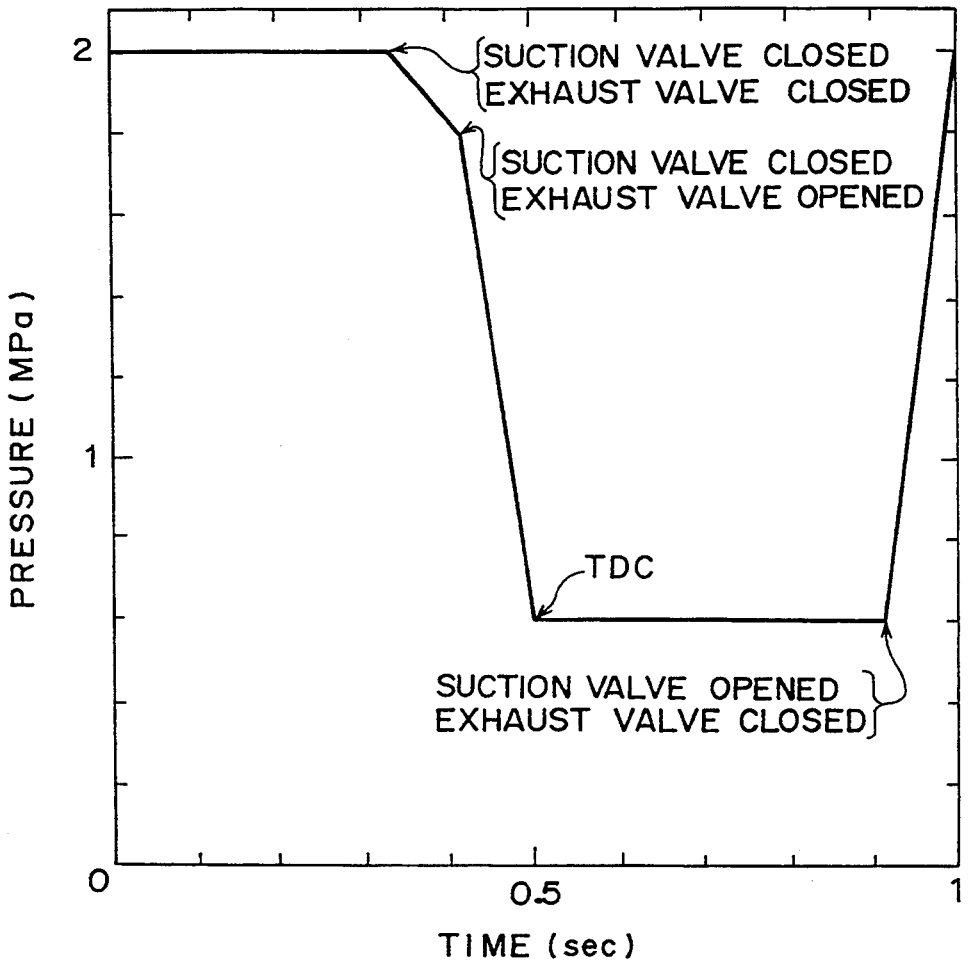
FIG. 21 is a view for graphically illustrating change in pressure in the refrigerating machine known heretofore.

FIG. 1 is a schematic diagram showing, partially in section, a general structure of a cold accumulation type refrigerating machine according to a first embodiment of the invention. In the figure, components same as or equivalent to those of the hitherto known refrigerating machine shown in FIG. 18 are denoted by like reference numerals and repeated description of these components is omitted. Referring to FIG. 1, in the refrigerating machine according to the instant embodiment, there is employed as the motor means a stepping motor 1 which is adapted to be driven under the control of a motor driving unit 2. Further provided in association with the stepping motor 1 is a pulse oscillation controller 3 which is designed to control an inter-pulse interval of a pulse voltage applied to the stepping motor 1 for controlling the rotation speed thereof. Except for these differences, the refrigerating machine according to the instant embodiment of the invention is substantially same as the one shown in FIG. 18.

Figure 2:
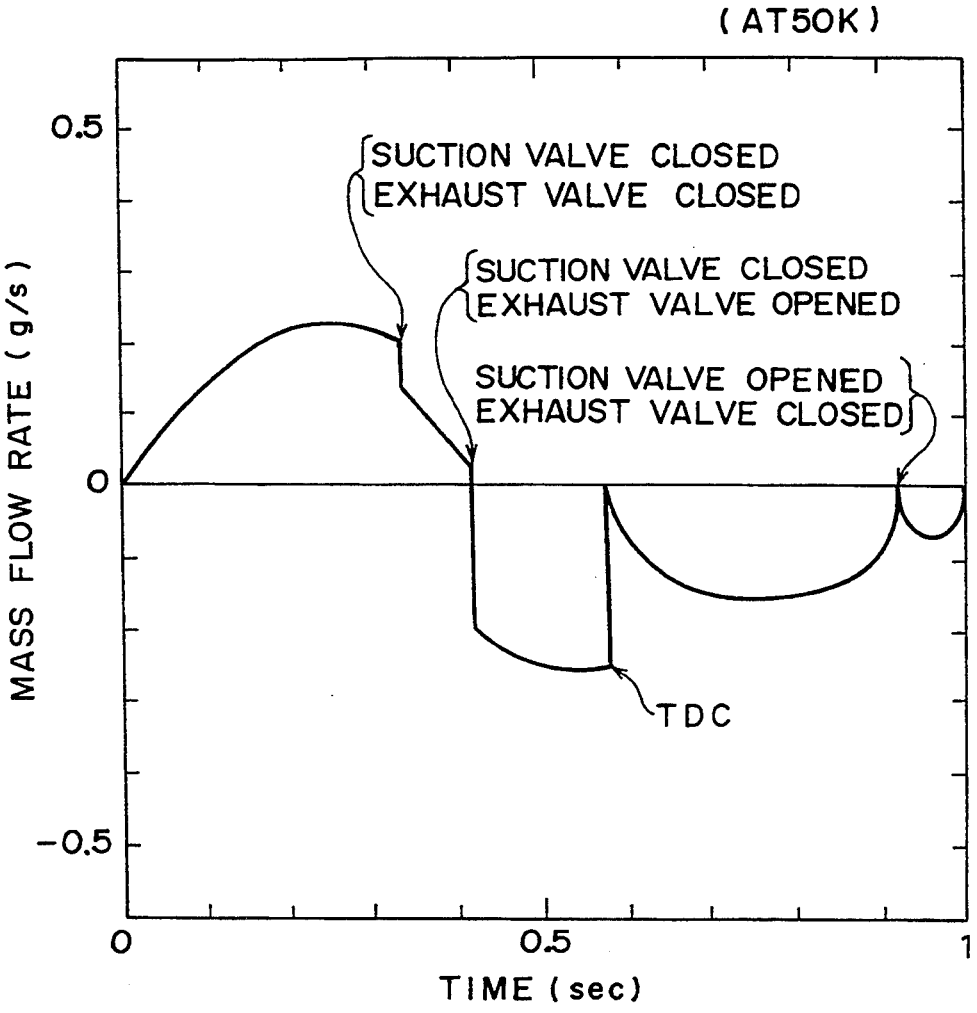
FIG. 2 is a view for graphically illustrating a change in the rate of gas flow into a gas expansion chamber defined within a cylinder of the refrigerating machine shown in FIG. 1.
Figure 22:
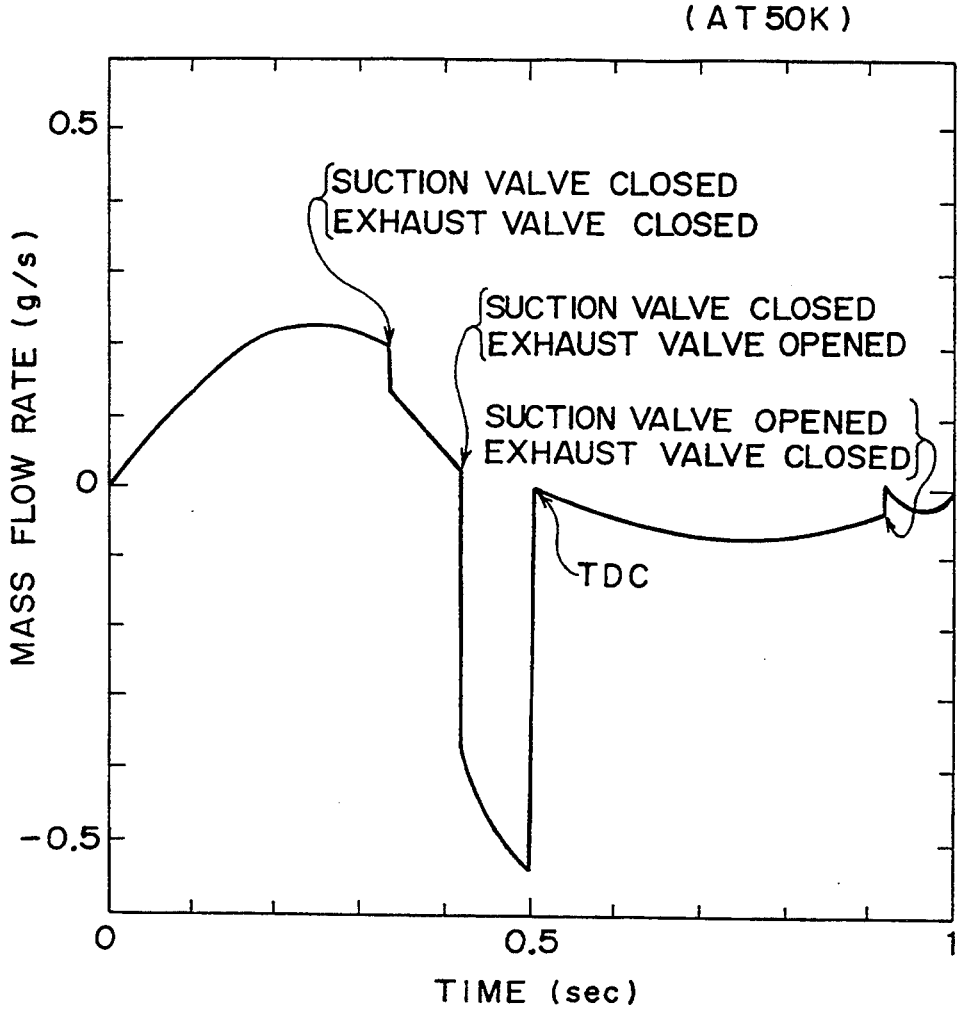
FIG. 22 is a view for illustrating graphically the rate of gas flow entering the gas expansion chamber after passing through a cold accumulator when the temperature of a heat conducting member is at 50 K. in the known refrigerating machine.

Now, description will be made of operation of the refrigerating machine according to the instant embodiment. It is proposed according to the teaching of the invention incarnated in this embodiment to control the rotation speed of the stepping motor over every operation cycle by the pulse oscillation controller 3 such that a time taken for the displacement member 14 reach the top dead center after a time point at which the discharge valve 9 is opened is increased twice as long as the corresponding time in the hitherto known refrigerating machine with the remaining time of the operation cycle being correspondingly decreased. In that case, change in a mass flow rate of the gas entering and exiting the expansion chamber is illustrated in FIG. 2 on the assumption that the period of the operation cycle is one second. As can be seen from FIG. 2, the mass flow rate of the gas at the moment when the discharge valve 9 is opened decreases by a half when compared with the corresponding flow rate in the refrigerating machine known heretofore (FIG. 22). Besides, the gas flow rate is smoothed or flattened as a whole. As a result, the efficiency of the cold accumulator 15 is improved by a factor of about two, which is reflected by corresponding increase in the efficiency improvement of the refrigerating capability of the refrigerating machine.

Further, owing to the arrangement in which the rotation speed of the stepping motor 1 is controlled by the pulse oscillation controller 3, the rotation speed of the stepping motor 3 can easily be controlled with a high accuracy. Parenthetically, the stepping motor as well as the pulse oscillation controller are known per se.

Thus, in the refrigerating machine according to the instant embodiment of the invention, the time taken for the displacement member 14 to reach the top dead center from the time point at which the discharge valve 9 is opened is increased twice as long as the corresponding time in the hitherto known refrigerating machine with the remaining time of the operation cycle being correspondingly shortened, whereby the mass flow rate of the gas at the moment when the discharge valve is opened is reduced by a half when compared with the known refrigerating machine and the gas flow is smoothed as a whole. With this arrangement, the efficiency of the cold accumulator 15 can be enhanced by a factor of about two, being accompanied with a corresponding enhancement in the efficiency of the refrigerating machine.

Embodiment 2

Figure 3:
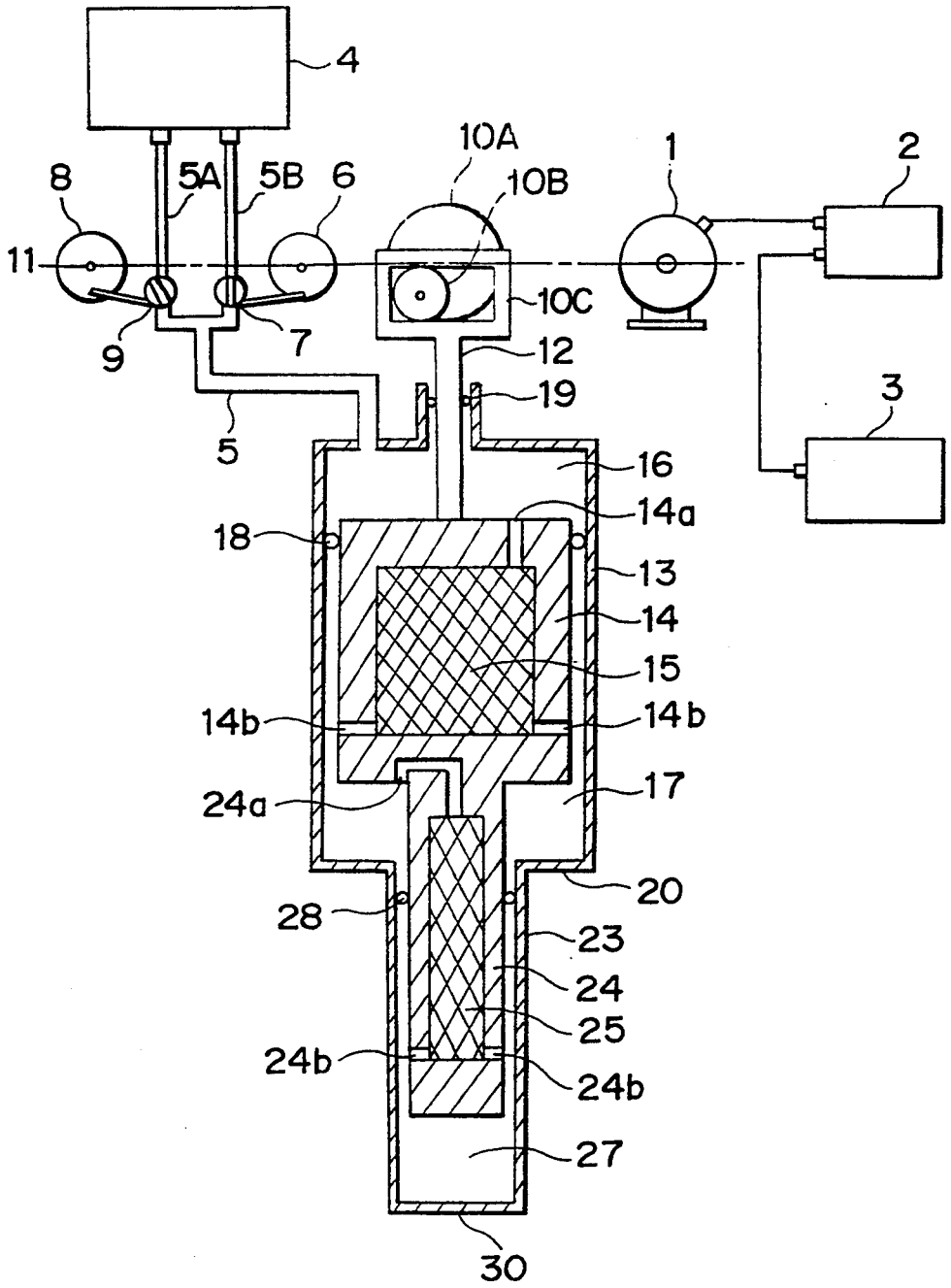
FIG. 3 is a diagram showing a structure of a cold accumulation type refrigerating machine according to a second embodiment of the invention.

FIG. 3 shows a cold accumulation type refrigerating machine according to a second embodiment of the invention. This refrigerating machine differs from the one shown in FIG. 1 in that a second cylinder 23 of a smaller volume than that of the cylinder 13 is disposed below the latter, a second displacement member 24 is disposed within the second cylinder 23 so as to move reciprocatively therein and incorporates a second cold accumulator 25 together with gas passages 24*a* and 24*b* communicated to the cold accumulator 25, a second hermetically closed gas expansion chamber 27 is defined between the displacement member 24 and the second cylinder 23, a seal 28 is provided to isolate the first bottom expansion chamber 17 and the second expansion chamber 27 from each other and that a heat conducting wall 30 is provided. Operation of the refrigerating machine according to the instant embodiment is the same as that of the first embodiment. Accordingly, repeated description thereof will be unnecessary. It should however be added that essentially same advantageous effects as those of the first embodiment can be obtained equally in the case of the second embodiment. Moreover, owing to additional provision of the displacement member 24 including interiorly the second cold accumulator 25, the refrigeration capability can further be enhanced.

Embodiment 3

Figure 4:
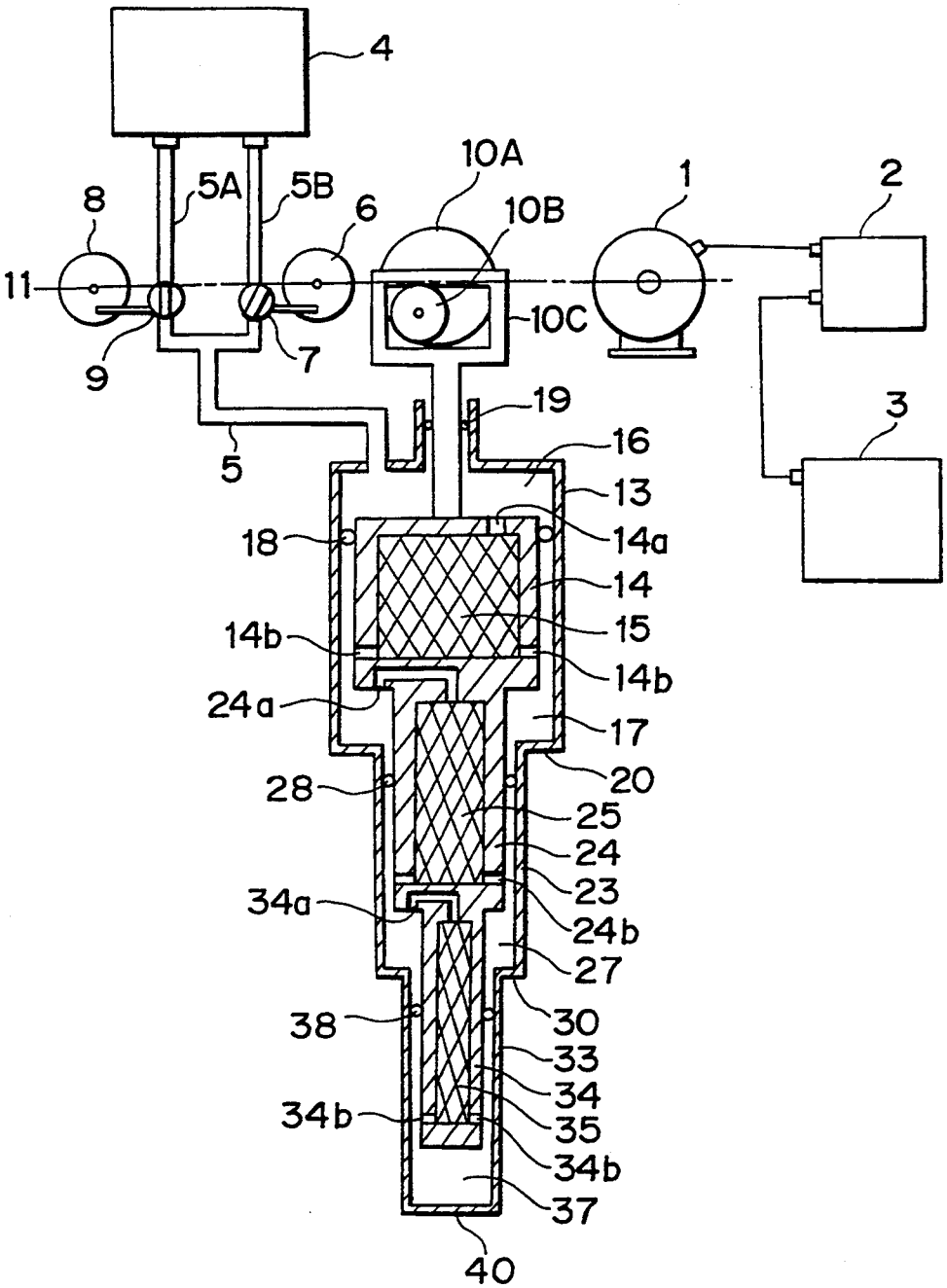
FIG. 4 is a diagram showing a structure of a cold accumulation type refrigerating machine according to a third embodiment of the invention.

FIG. 4 is a diagram showing generally a structure of the refrigerating machine according to a third embodiment of the invention. The instant embodiment differs from the second one described above in that the cold accumulators are provided in three stages. More specifically, in the refrigerating machine of the instant embodiment, there are provided additionally a third cylinder 33 disposed below the second cylinder 32 and having a smaller volume than that of the cylinder 23, a third displacement member 34 disposed reciprocatively movably within the third cylinder 33 and including a third cold accumulator 35 with gas passages 34*a* and 34*b* communicated thereto, a third gas expansion chamber 37 enclosed and defined by the third displacement member 34 and the third cylinder 26, and a seal 38 for isolating the second gas expansion chamber 27 and the third gas expansion chamber from each other. Further, the third heat conducting portion 40 is provided at the bottom of the third cylinder 33. With this structure, substantially the same advantageous effects as those attained with the refrigerating machine according to the first and second embodiments can be obtained. Moreover, because of the presence of three heat exchangers in the stacked disposition, the refrigerating performance and efficiency can further be increased. The control operation of the refrigerating machine of the instant embodiment is performed in the same manner as described previously in conjunction with the first embodiment. Accordingly, repeated description will be unnecessary.

Embodiment 4

Figure 5:
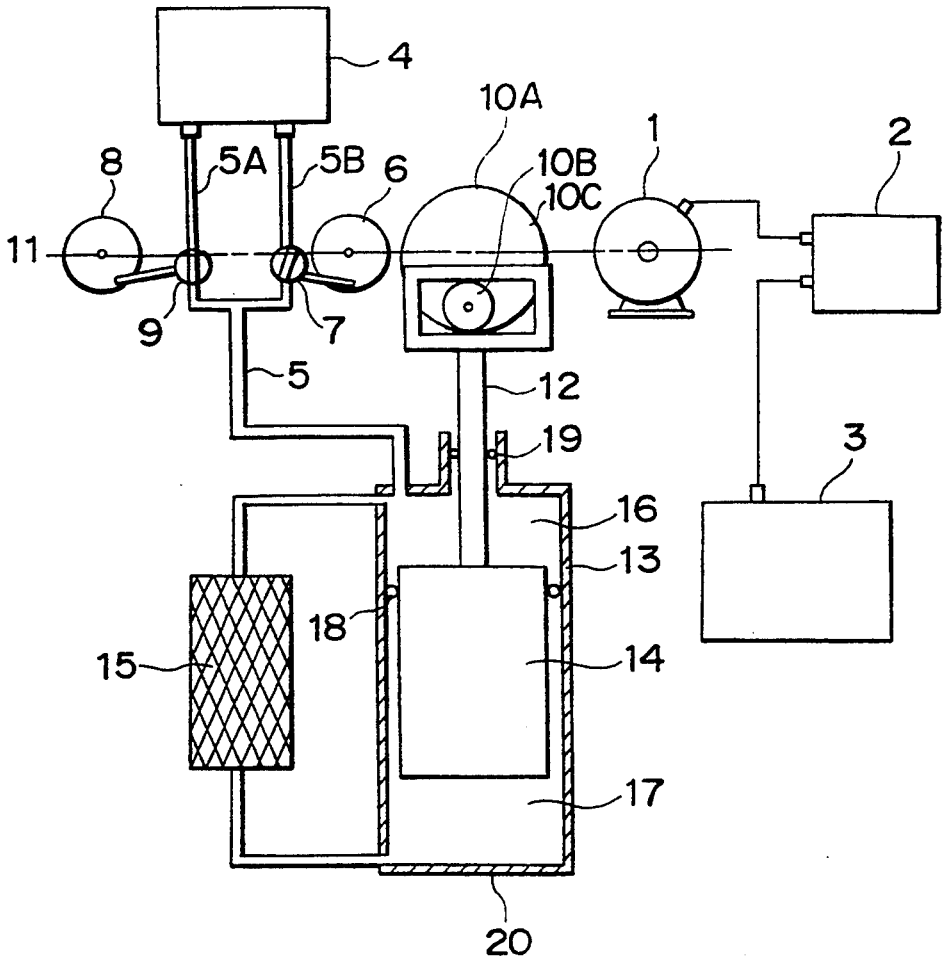
FIG. 5 is a diagram showing a structure of a cold accumulation type refrigerating machine according to a fourth embodiment of the invention.
Figure 6A:
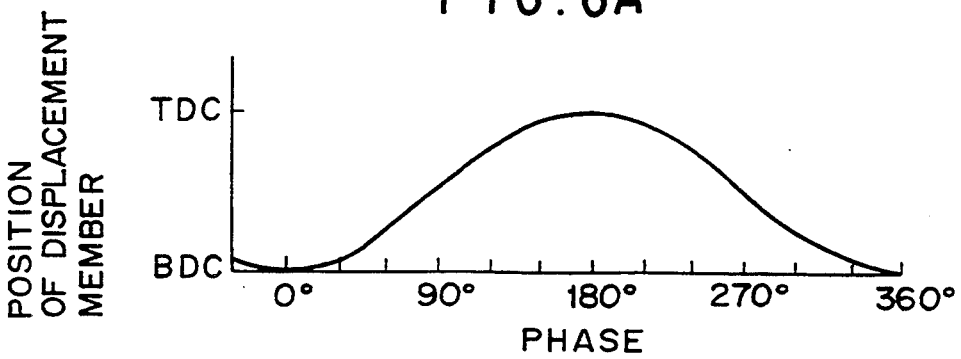
FIGS. 6(*a*), 6(*b*), 6(*c*) and 6(*d*) are views for graphically illustrating relations among a position of a displacement member, opening degrees of suction and discharge valves, change in pressure within a gas expansion chamber and a phase angle in a cold accumulation type refrigerating machine according to a fifth embodiment of the invention.
Figure 6B:
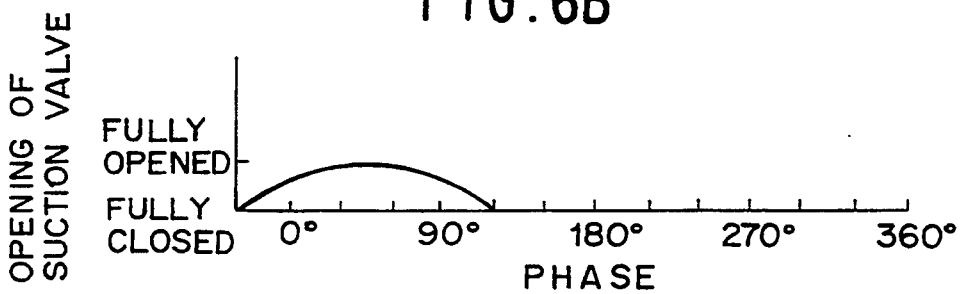
Figure 6C:
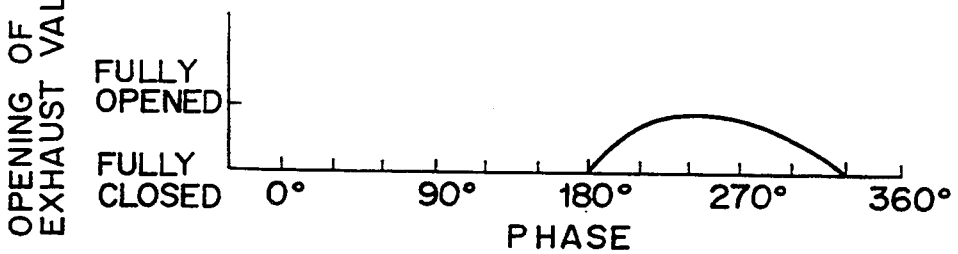
Figure 6D:
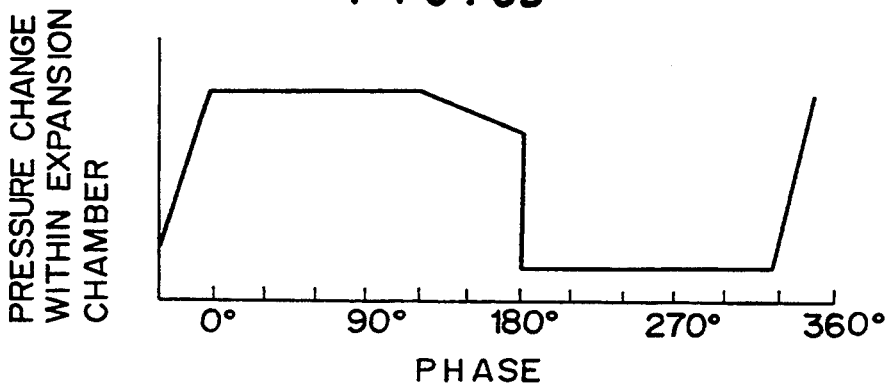

This embodiment is also a modification of the first embodiment. FIG. 4 shows generally a structure of the refrigerating machine according to a fourth embodiment of the invention. Referring to FIG. 5, the instant embodiment differs from the first one in that the cold accumulator (heat exchanger) 15 is disposed outside of the cylinder 13. With this arrangement, the aimed effects can equally be achieved. Since the control operation of the refrigerating machine is the same as that of the first embodiment, repeated description is omitted.

Embodiment 5

This embodiment differs from the first one in that the electric motor 1 is controlled in such a manner that the discharge valve 9 is opened substantially at the same time point at which the displacement member 14 reaches the top dead center and that the rotation speed of the motor 1 is lowered during a predetermined period close to the time point at which the displacement member reaches the top dead center. FIGS. 6(*a*)–6(*b*)are views for graphically illustrating relations among a position of the displacement member, opening degrees of suction and discharge valves, change in pressure within the gas expansion chamber and a phase angle in the cold accumulation type refrigerating machine according to a fifth embodiment of the invention. The above-mentioned predetermined period may be so selected as to correspond to coverage of 30° in terms of the phase angle.

Figure 7A:
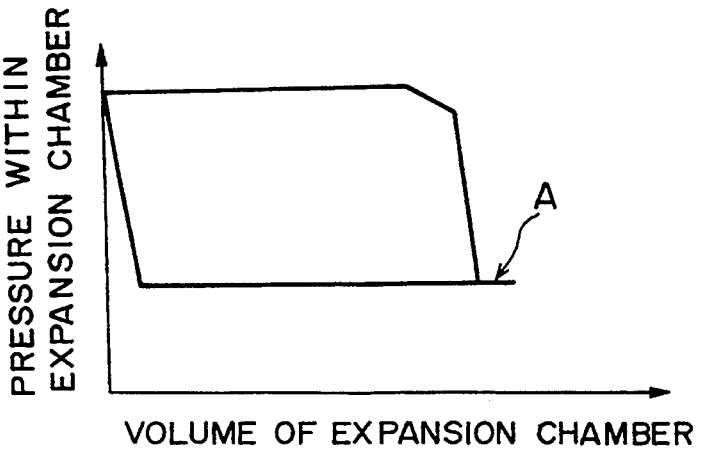
FIG. 7A is a view showing graphically a P-V characteristic of the refrigerating machine according to the first embodiment of the invention.
Figure 7B:
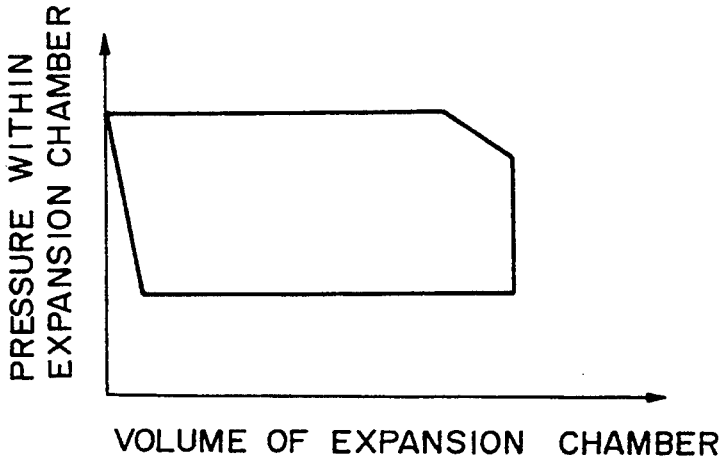
FIG. 7B is a view showing graphically a P-V characteristic of the refrigerating machine according to the fifth embodiment of the invention.
Figure 8A:
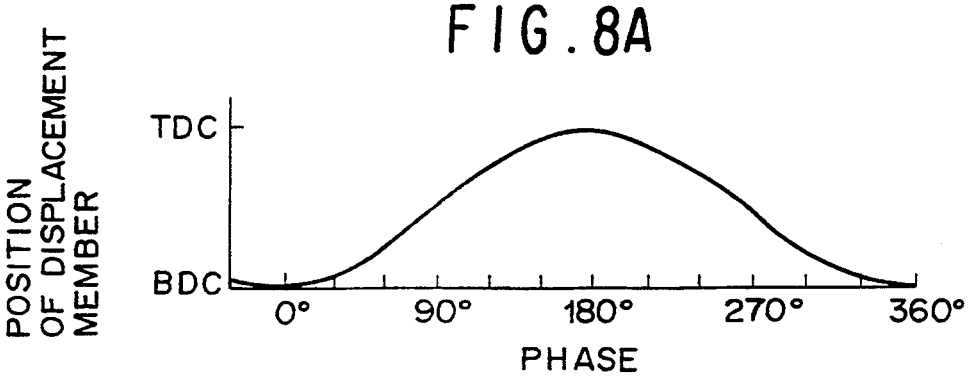
FIGS. 8(*a*), 8(*b*), 8(*c*) and 8(*d*) are views for graphically illustrating relations among a position of a displacement member, opening of suction and discharge valves, change in pressure within a gas expansion chamber and a phase angle in a cold accumulation type refrigerating machine according to a sixth embodiment of the invention.
Figure 8B:
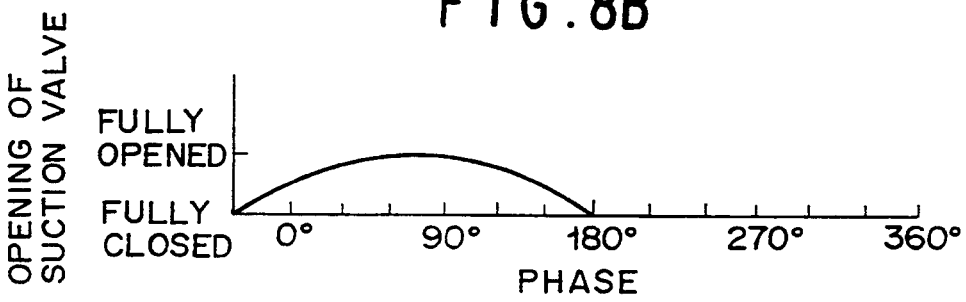
Figure 8C:
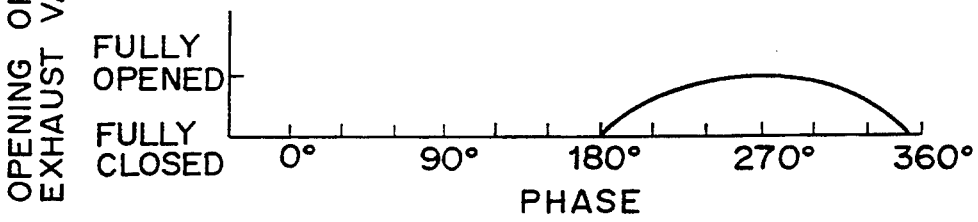
Figure 8D:
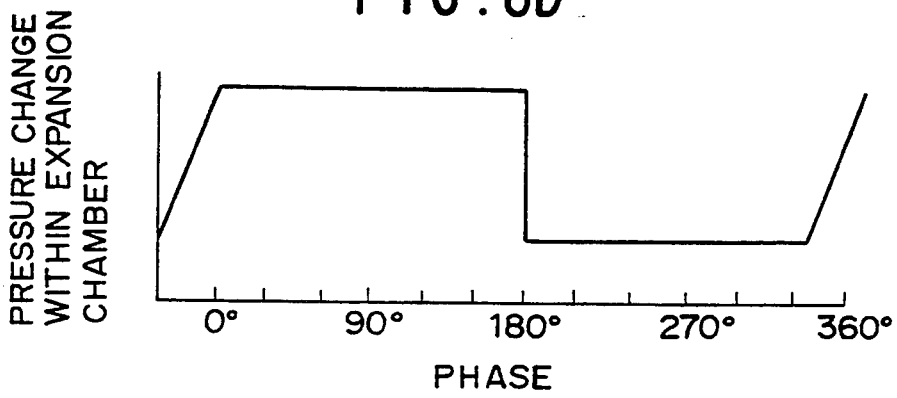

In the case of the first embodiment, there is a possibility that a loss indicated at A in a pressure-versus-volume (P-V) characteristic curve shown in FIG. 7 due to such control that the time taken for the displacement member 14 to reach the top dead center after opening of the discharge valve 9 is prolonged. In this regard, the loss A represents the loss in the indicated work (equivalent to the enclosed area in the P-V characteristic graph). In order to avoid such loss in the indicated work, it is taught according to the teaching of the invention incarnated in the instant embodiment that the discharge valve 9 is opened substantially at the same time when the displacement member 14 reaches the top dead center. As the consequence, the P-V characteristic is improved, as indicated at FIG. 7B, wherein no loss is involved in the indicated work. Further, the rotation speed of the stepping motor 1 is so controlled that the moving speed of the displacement member 14 is lowered (i.e., the discharge valve 9 is opened slowly) within a range located in the vicinity of the top dead center of the displacement member 14, whereby the gas flow rate is prevented from changing rapidly. Thus, the flow rate is uniformed or flattened through out the operation cycle, making contribution to increase in the efficiency of the cold accumulator 15 and hence the refrigeration capability of the refrigerating machine.

Embodiment 6

This embodiment represents a modification of the refrigerating machine according to the first embodiment in respect to the control. FIGS. 8(*a*)–8(*d*) are views for graphically illustrating relations among a position of the displacement member, opening degrees of suction and discharge valves, change in pressure within the gas expansion second chamber and a phase angle in the cold accumulation type refrigerating machine according to a sixth embodiment of the invention. The instant embodiment differs from the first one in that the electric motor 1 is controlled such that time points at which the suction valve 7 and the discharge valve 9 are opened, respectively, are so set as to substantially coincide with a time point at which the displacement member 14 reaches the top dead center and that the rotation speed of the motor 1 is lowered during a predetermined period close to the time point at which the displacement member 14 reaches the top dead center. The instant embodiment can ensure the advantages equivalent to those of the first embodiment. Besides, the indicated work can be improved over that of the refrigerating machine according to the fifth embodiment, assuring correspondingly enhanced refrigeration capability.

Embodiment 7

Figure 9:
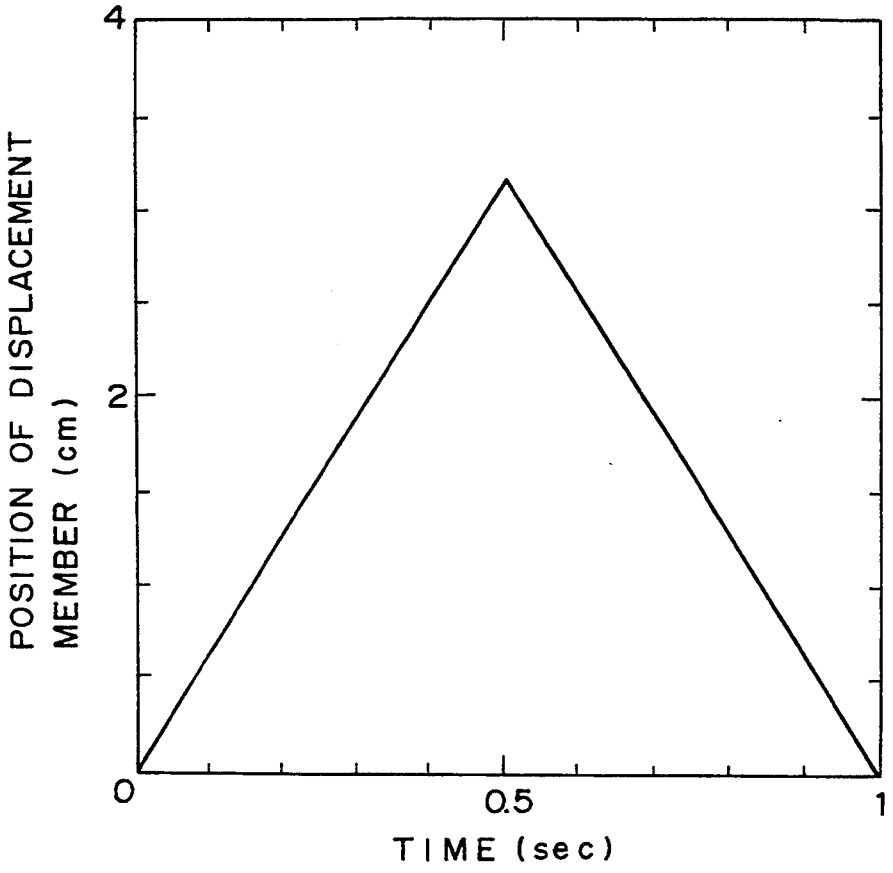
FIG. 9 is a view for graphically illustrating positions assumed by a displacement member as a function of time according to a seventh embodiment of the invention.
Figure 10:
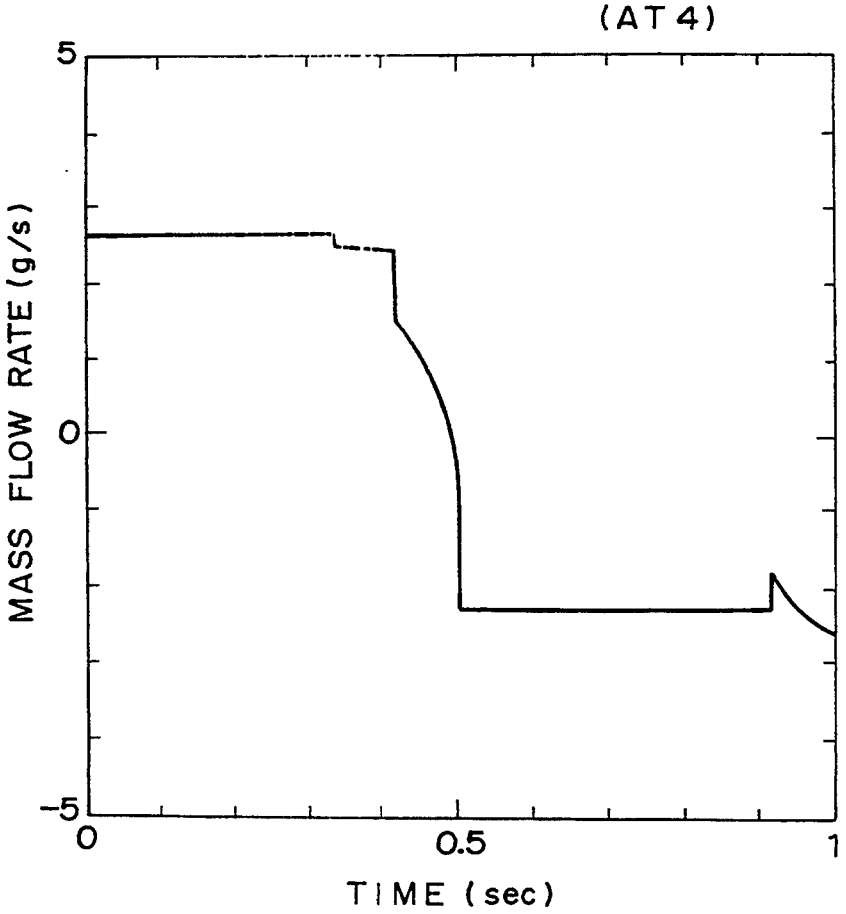
FIG. 10 is a view for graphically illustrating change in the rate of gas flow into the gas expansion chamber defined within the cylinder of the refrigerating machine according to the seventh embodiment of the invention.

FIG. 9 graphically illustrates the position of the displacement member as a function of time in the cold accumulation type refrigerating machine according to a seventh embodiment of the invention. The refrigerating machine of the instant embodiment differs from that of the first embodiment in that the displacement member 14 is moved at a uniform speed from the bottom dead center to the top dead center as well as from the top dead center to the bottom dead center. According to the teaching of the invention incarnated in this embodiment, the rate of gas flow in the closed gas expansion chamber 17 remains substantially constant due to the uniform-speed linear motion of the displacement member when the heat conducting wall 20 is at 4.2 K., as can be seen from FIG. 10. Consequently, the cold accumulator 15 can easily be designated with the efficiency thereof and hence that of the refrigerating machine being enhanced.

Embodiment 8

Figure 11:
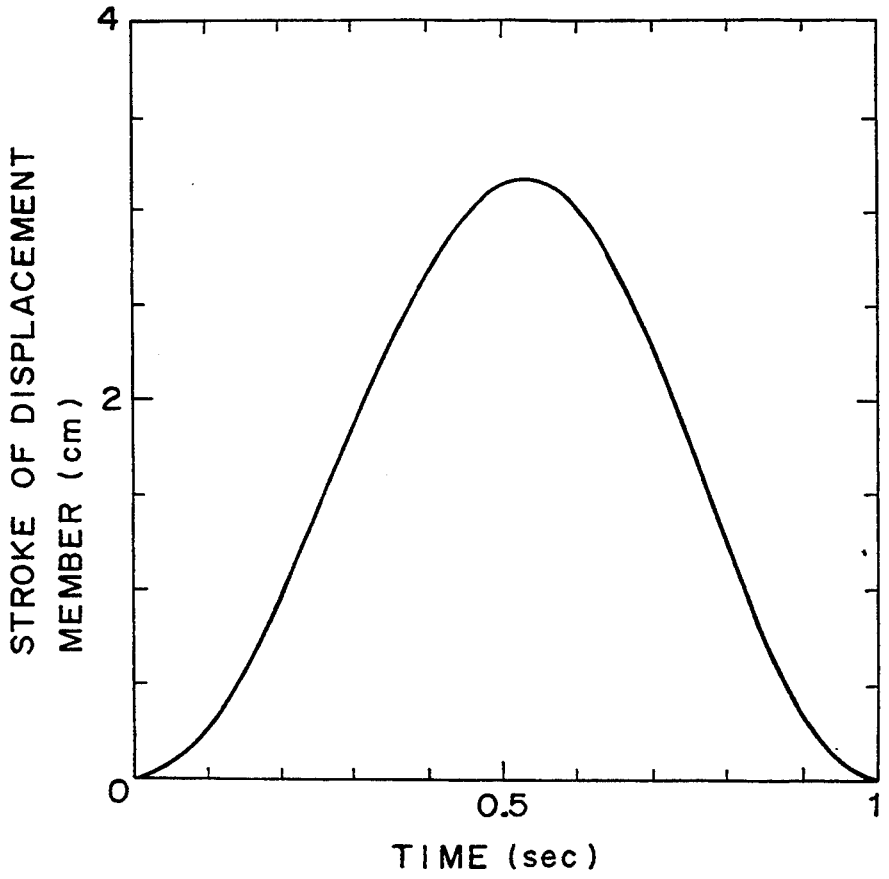
FIG. 11 is a view for graphically illustrating positions assumed by a displacement member as a function of time according to an eighth embodiment of the invention.
Figure 12:
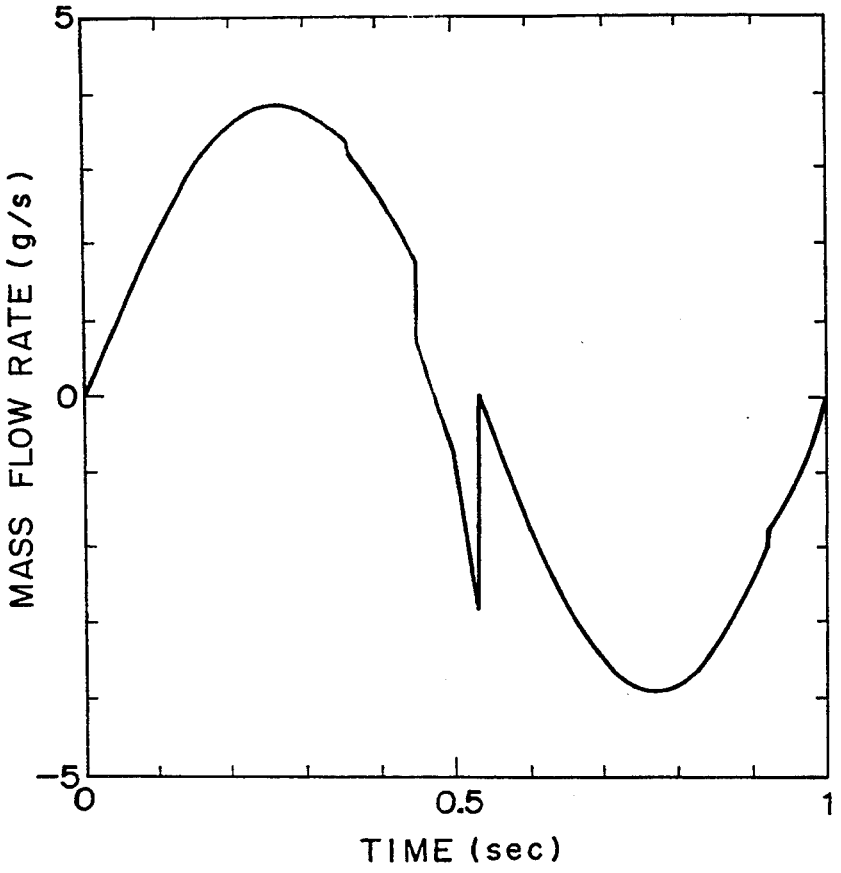
FIG. 12 is a view for graphically illustrating changes in the rate of gas flow into the gas expansion chamber of the refrigerating machine according to the eighth embodiment of the invention.

FIG. 11 is a view for graphically illustrating positions of the displacement member as a function of time in the refrigerating machine according to an eighth embodiment of the invention. In the case of the refrigerating machine of this embodiment, the rotation speed of the motor 1 is so controlled that the time taken for the displacement member 14 to move from the bottom dead center to the top dead center is longer than the time taken for the displacement member 14 to move from the top dead center to the bottom dead center. By virtue of the control mentioned above, the maximum flow rate of the gas entering the closed bottom chamber 17 is decreased to be substantially equal to the maximum flow rate, when the gas exits the closed bottom chamber 17, as shown in FIG. 12. Thus, the gas flow rate is smoothed more flatly, whereby efficiency of the cold accumulator 15 and hence that of the refrigerating machine are improved.

Embodiment 9

Figure 13:
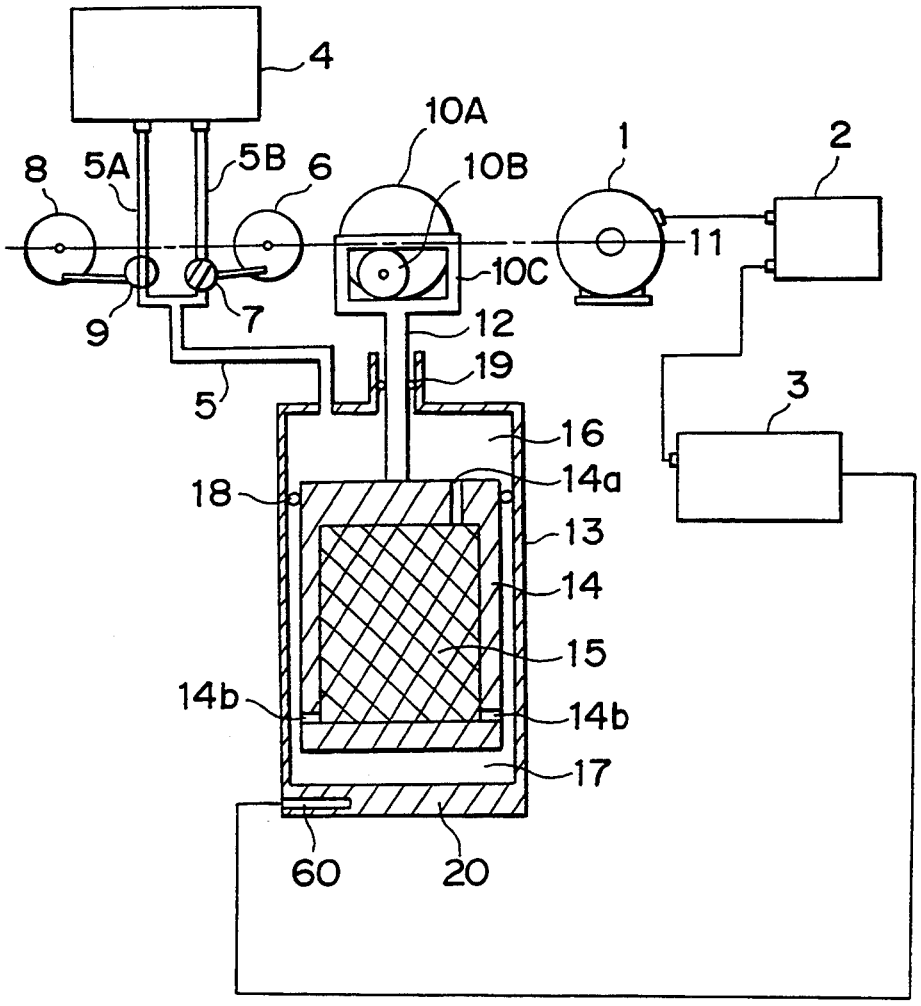
FIG. 13 is a diagram showing a structure of a cold accumulation type refrigerating machine according to a ninth embodiment of the invention.

FIG. 13 is a diagram showing a structure of a cold accumulation type refrigerating machine according to a ninth embodiment of the invention. This embodiment differs from the first one in that a temperature sensor 60 is provided for detecting the temperature of the heat conducting wall 20 and that the pulse oscillation controller 3 is so designed as to control the rotation speed of the stepping motor 1 in dependence on the output of the temperature sensor 60.

Figure 23:
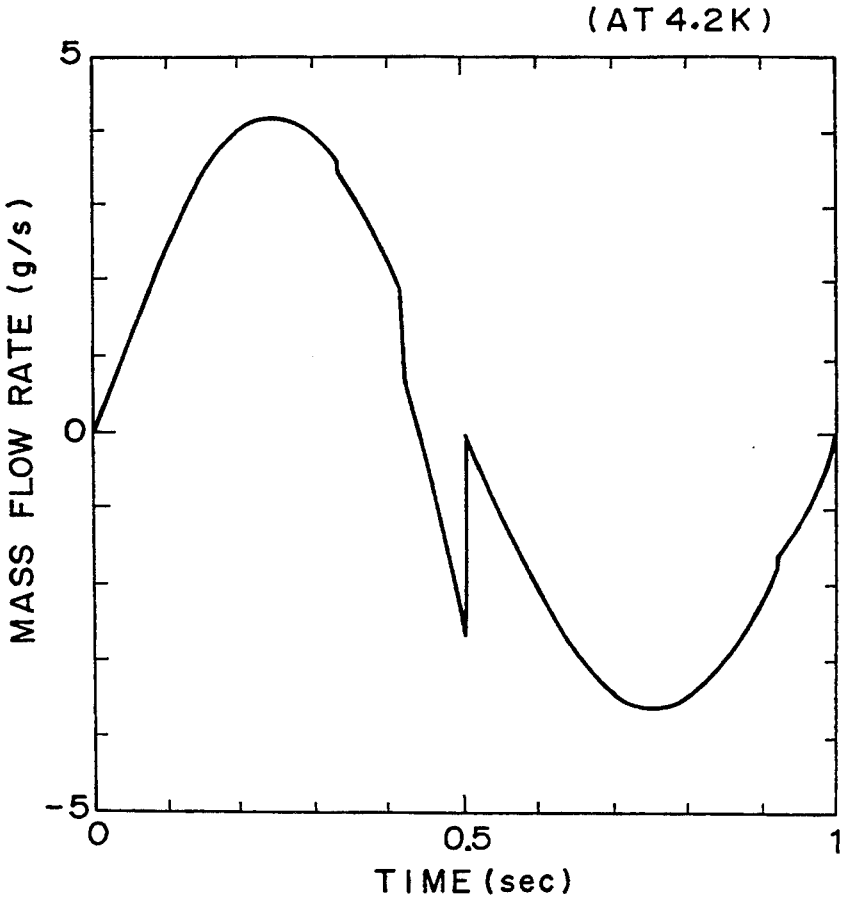
FIG. 23 is a view illustrating graphically a change in the rate of gas flow entering the gas expansion chamber via the cold accumulator when the temperature of the heat conducting member is at 4.2 K. in the known refrigerating machine.

In this regard, the flow rate of helium gas flowing into or out of the closed bottom chamber 17 differs in dependence on the temperature of the gas. By way of example, when the gas temperature is 50 K., the flow rate is such as shown in FIG. 22, while at the gas temperature of 4.2 K. the flow rate is such as illustrated in FIG. 23. Accordingly, it is desirable to change the rotation speed of the motor 1 in dependence on the temperature of the coolant gas. Now, let's assume that the output signal of the temperature sensor 60 indicates that the heat conducting wall 20 is at 50 K. In that case, the pulse oscillation controller 3 controls the rotation speed of the stepping motor 1 so that the displacement member 14 is moved in the same manner as in the case of the first embodiment. When the temperature of the heat conducting wall decreases to a level at which the output of the temperature sensor 60 indicates 4.2 K., the pulse oscillation controller 3 then controls the rotation speed of the stepping motor 1 such that the displacement member 14 is moved in the same manner as described hereinbefore in conjunction with the seventh embodiment.

With the arrangement of the refrigerating machine according to the instant embodiment, the flow rate of the coolant gas over one cycle can constantly be smoothed through a whole temperature range from the initial to the target temperature, whereby the efficiency of the cold accumulator 15 and hence that of the refrigerating machine can be increased.

Embodiment 10

Figure 14:
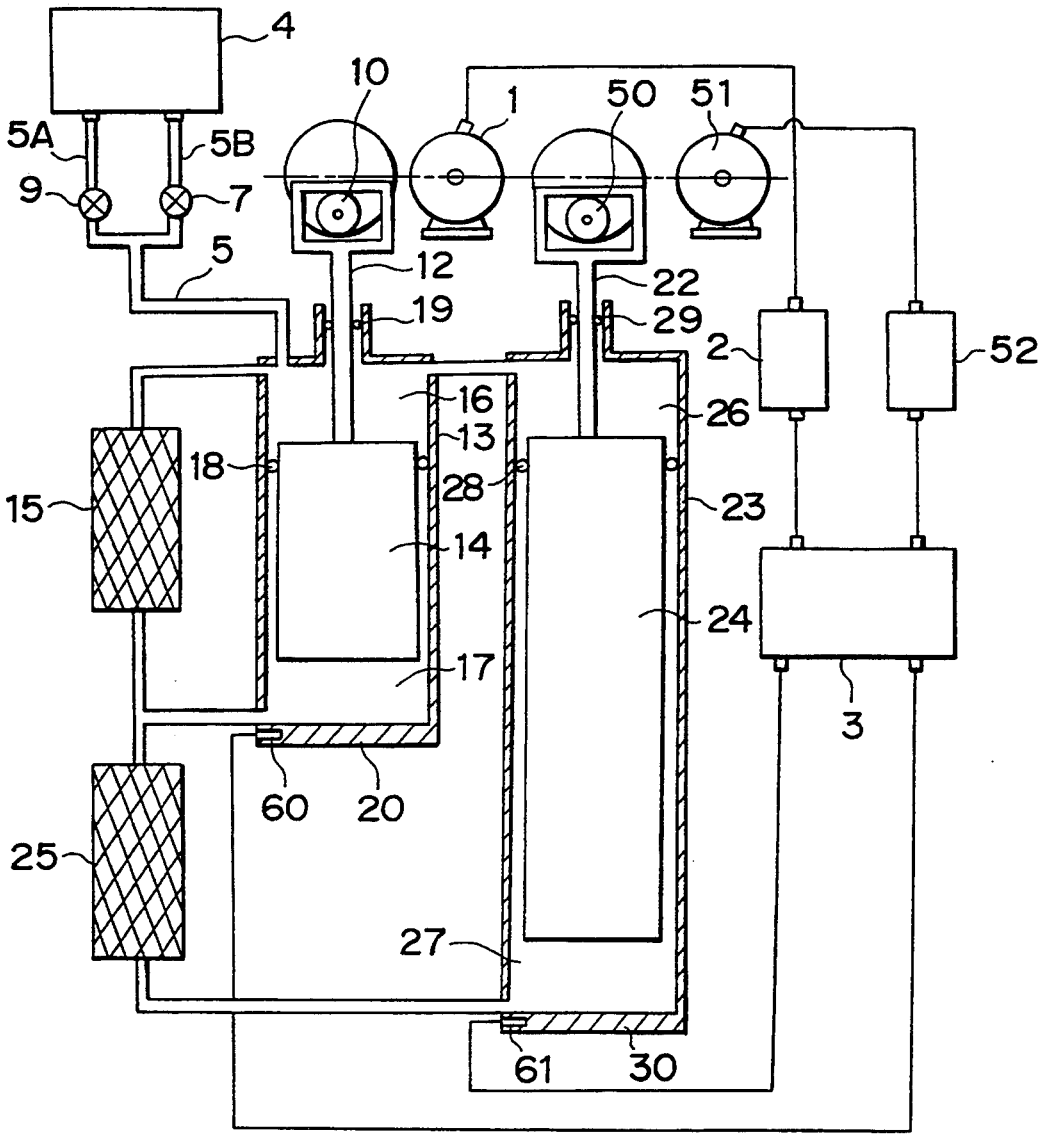
FIG. 14 is a diagram showing a structure of a cold accumulation type refrigerating machine according to a tenth embodiment of the invention.

FIG. 14 is a diagram showing a structure of a cold accumulation type refrigerating machine according to a tenth embodiment of the invention. In the case of the refrigerating machine of this embodiment, heat exchangers 15 and 25 constituting the cold accumulators are disposed outside of the respective cylinders 16 and 23. Rotation of the output shaft of an additional stepping motor 51 is converted into the reciprocative motion of a displacement member 24 through a bearing 50 and a piston rod 22. The stepping motor 51 is driven by a motor driving device 52 under the control of the pulse oscillation controller 3. Further, temperature sensors 60 and 61 are provided in association with heat conducting walls 20 and 30, respectively.

Description will turn to operation of the refrigerating machine according to the instant embodiment. Temperatures of the heat conducting walls 20 and 30 are detected by the temperature sensors 60 and 61, respectively. In this regard, it is noted that the temperature of the heat conducting wall 30 is lower than that of the heat conducting wall 20. Assuming, by way of example, that the temperature of the heat conducting wall 20 is 50 K. with that of the heat conducting wall 30 being 4.2 K., the mass flow rate of the gas entering the closed bottom chamber 17 changes as a function of time in such a manner as illustrated in FIG. 22, while that of the gas entering the third closed chamber 27 changes in a manner illustrated in FIG. 23. Consequently, the optimum rotation speed of the stepping motor 1 differs from that of the stepping motor 51. Accordingly, the stepping motor 1 is controlled in the same manner as described hereinbefore in conjunction with the first, second, third or fourth embodiment, while the stepping motor 51 is controlled as in the case of the seventh embodiment, whereby the efficiencies of the cold accumulators 15 and 25 and hence that of the refrigerating machine are enhanced.

Embodiment 11

Figure 15:
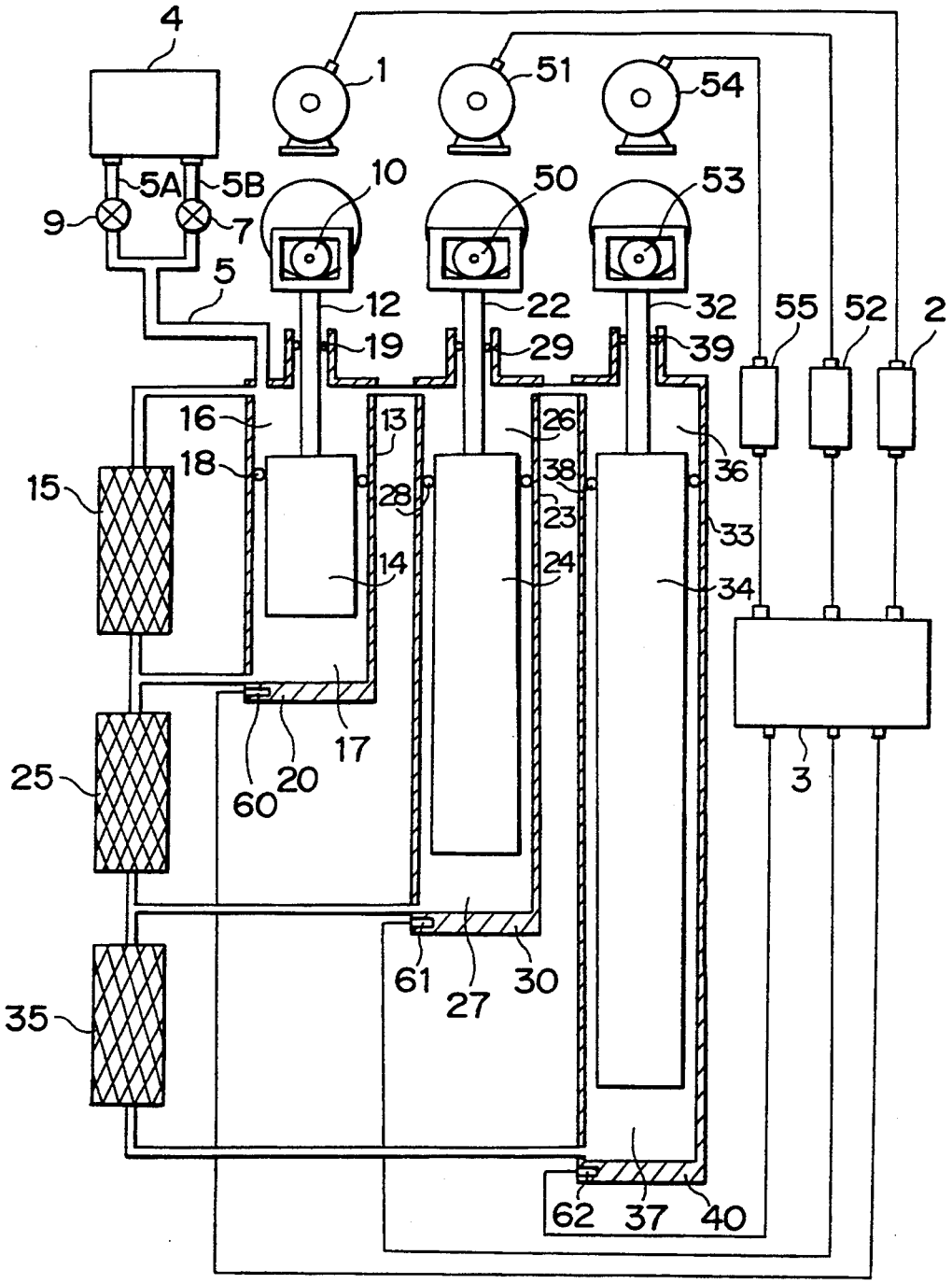
FIG. 15 is a diagram showing a structure of a cold accumulation type refrigerating machine according to an eleventh embodiment of the invention.

FIG. 15 is a diagram showing a structure of a cold accumulation type refrigerating machine according to an eleventh embodiment of the invention. In the case of the refrigerating machine according to the instant embodiment, heat exchangers 15, 25 and 35 are disposed outside of associated cylinders 13, 23 and 33, respectively. Further, the second and third stepping motors 51 and 54 are provided in addition to the stepping motor 1 for moving associated displacement members 24 and 34 reciprocatively within cylinders 23 and 33 through bearings 50 and 53 and piston rods 22 and 32, respectively. The stepping motors 51 and 54 are driven by respective driving circuits 52 and 55 under the control of the pulse oscillation controller 3. Further, temperature sensors 60, 61 and 62 are mounted on heat conducting walls 20, 30 and 40, respectively. The rotation speed of the stepping motors 1, 51 and 54 are controlled in a same manner as described previously in conjunction with the tenth embodiment.

Embodiment 12

Figure 16:
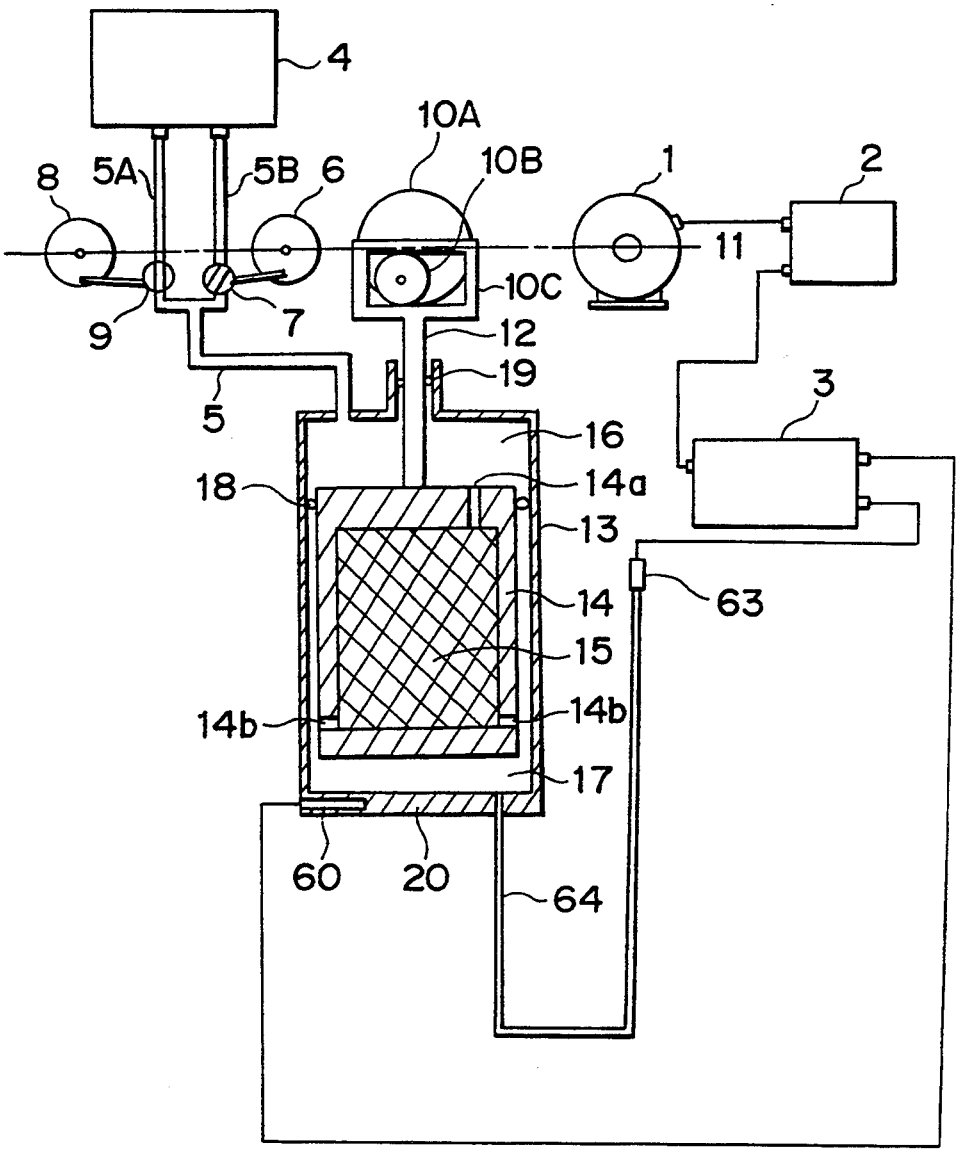
FIG. 16 is a diagram showing a structure of a cold accumulation type refrigerating machine according to a twelfth embodiment of the invention.

FIG. 16 is a diagram showing a structure of a cold accumulation type refrigerating machine according to a twelfth embodiment of the invention. In the refrigerating machine according to this embodiment, a pressure sensor 63 is provided in communication with the closed bottom chamber 17 defined within the cylinder 13. The output signal of the pressure sensor 60 is supplied to the pulse oscillation controller 3 which is designated or programmed to calculate the gas flow to the closed bottom chamber 17 in accordance with the following expression:

$$i\,F = d(\rho V)/dt \quad (1)$$

where F represents the mass flow rate, $\rho$ represents a gas density within the closed bottom chamber 17 and V represents a volume of the closed bottom chamber 17. The rotation speed of the stepping motor 1 is controlled so that the flow rate of the coolant gas entering the closed bottom chamber 17 satisfies the above-mentioned condition. It goes without saying that the gas flow rate can be smoothed throughout the operation cycle to substantially same advantageous effects as those of the preceding embodiments.

Embodiment 13

Figure 17:
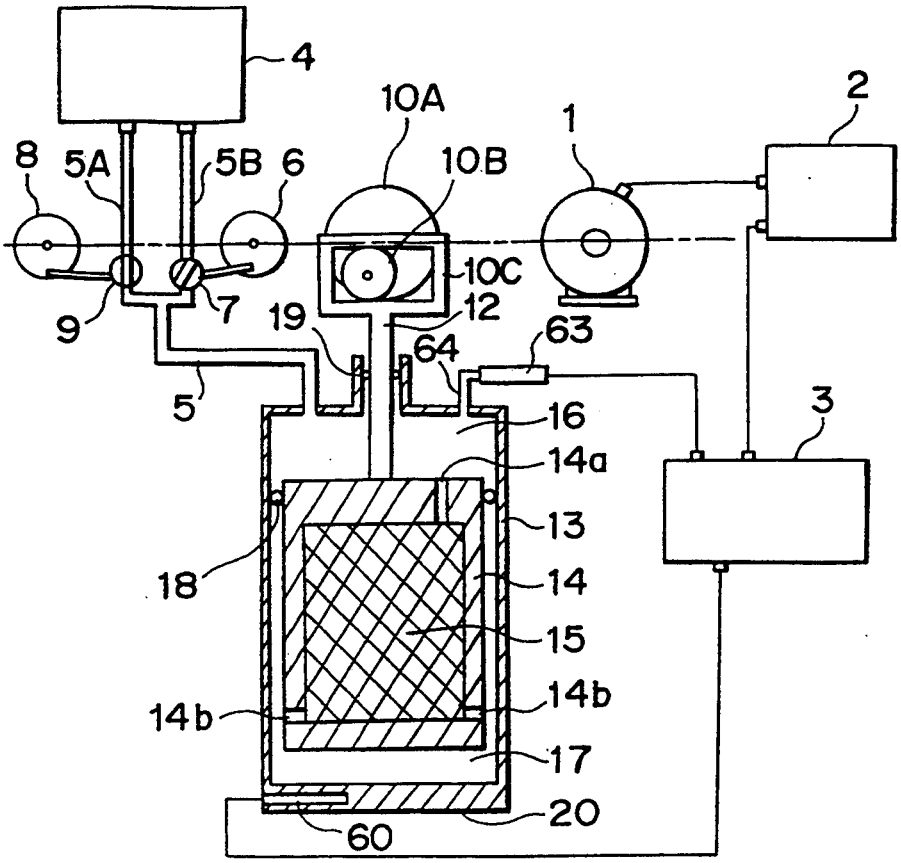
FIG. 17 is a diagram showing a structure of a cold accumulation type refrigerating machine according to a thirteenth embodiment of the invention.

FIG. 17 is a diagram showing a structure of a cold accumulation type refrigerating machine according to a thirteenth embodiment of the invention. In the refrigerating machine according to this embodiment, the pressure sensor 63 is disposed in communication with the closed top chamber 16 via a pressure conduit 64. Since the pressure drop across the cold accumulator 15 is negligibly small, the pressure within the closed top chamber 16 represents the pressure within the second chamber 17 with a reasonable accuracy. Of course, the rotation speed of the stepping motor 1 is controlled so as to satisfy the condition given by the expression (1).

Many features and advantages of the present invention are apparent from the detailed description and thus it is intended by the appended claims to cover all such features and advantages of the system which fall within the true spirit and scope of the invention. Further, since numerous modifications and combinations will readily occur to those skilled in the art, it is not intended to limit the invention to the exact construction and operation illustrated and described. Although the invention has been described in conjunction with Gifford-McMahon type refrigerating machine, the invention can equally be applied to other types of refrigerating machines such as Solvay-cycle type refrigerating machine, Stirling type refrigerating machine, Bill Mayer type refrigerator and others. Accordingly, all suitable modifications and equivalents may be resorted to, falling within the spirit and scope of the invention.

We claim:

1. A cold accumulation type refrigerating machine, comprising:

electric motor means having a rotatable output shaft;

means for converting rotation of said output shaft into a linear reciprocative motion of a displacement member disposed within a stationary cylinder;

a hermetically closed gas expansion chamber defined within said cylinder below said displacement member and having a volume variable as said displacement member moves reciprocatively;

a gas compressor having an outlet port communicated to said expansion chamber through a first valve and a cold accumulator for feeding a compressed gas discharged from said gas compressor to said expansion chamber through said cold accumulator when said first valve is opened, said gas being caused to expand within said expansion chamber, a second valve being provided in communication with said expansion chamber so that said gas which has undergone the expansion within said expansion chamber is fed back to said gas compressor through said cold accumulator when said second valve is opened, wherein feeding of said compressed gas into said expansion chamber, expansion thereof within said expansion chamber and feeding back of said gas to said compressor after the expansion constitute one cycle of operation of said refrigerating machine; and control means for changing a rotation speed of said electric motor during said operation cycle so that a flow rate of gas flowing through said cold accumulator remains substantially uniform through said operation cycle;

wherein:

said electric motor means is constituted by a stepping motor;

said control means for changing the rotation speed of said motor means over said one cycle of operation includes a pulse oscillation controller for controlling the rotation speed of said stepping motor; and said control means controls the rotation speed of said electric motor means such that said rotation speed of said motor is low during a period extending from a time point at which said second valve is opened to a time point at which said displacement member reaches a top dead center while increasing said rotation speed during the remaining period of said operation cycle.

2. A cold accumulation type refrigerating machine according to claim 1, wherein said control means controls the rotation speed of said motor means such that said time taken for said displacement member to reach said top dead center point from said time point at which said second valve is opened is increased by a factor of two when compared with a corresponding time taken by said displacement member on an assumption that said motor means is rotated at a constant speed, the remaining time in said one operation cycle being correspondingly shortened.

3. A cold accumulation type refrigerating machine according to claim 1, further comprising:

a second cylinder having a smaller volume than that of said first cylinder and disposed below said first cylinder;

a second displacement member disposed within said second cylinder and connected to said first displacement member so as to move reciprocatively within said second cylinder while carrying a second cold accumulator together with gas passages communicated to said second cold accumulator;

a second hermetically closed gas expansion chamber defined within said second cylinder below said second displacement member;

a seal for isolating said closed chamber and said second closed chamber from each other; and a heat conducting portion formed in a wall of said second cylinder below said second closed chamber;

wherein said control means controls the rotation speed of said electric motor during said operation cycle so that a flow rate of gas entering said second closed chamber remains substantially constant throughout said operation cycle.

4. A cold accumulation type refrigerating machine according to claim 3, further comprising:

a third cylinder having a smaller volume than that of said second cylinder and disposed below said second cylinder;

a third displacement member disposed within said third cylinder and connected to said second displacement member so as to move reciprocatively within said third cylinder, said third displacement member carrying a third cold accumulator together with gas passages communicated to said third cold accumulator;

a third hermetically closed gas expansion chamber defined within said third cylinder below said third displacement member;

a seal for isolating said second gas expansion chamber and said third gas expansion chamber from each other; and a heat conducting portion formed in a wall of said third cylinder below said third closed chamber;

wherein said control means controls the rotation speed of said electric motor during said operation cycle so that a flow rate of gas entering said third closed chamber remains substantially constant throughout said operation cycle.

5. A cold accumulation type refrigerating machine according to claim 1, wherein said cold accumulator is disposed within said displacement member and communication with a top chamber defined above said displacement member and with said expansion chamber through respective passages.

6. A cold accumulation type refrigerating machine according to claim 1, wherein said cold accumulator is disposed externally of said cylinder and communicates with a top chamber defined above said displacement member and with said expansion chamber through respective passages.

7. A cold accumulation type refrigerating machine according to claim 1, wherein said control means controls said electric motor means such that said second valve is opened substantially at a same time point at which said displacement member reaches a top dead center and that the rotation speed of said motor means is lowered during said predetermined period close to said time point at which said displacement member reaches said top dead center.

8. A cold accumulation type refrigerating machine according to claims 7, wherein said predetermined period corresponds to a coverage of 30° in phase angle when said one cycle is represented in terms of phase angle of 360°.

9. A cold accumulation type refrigerating machine according to claim 1, wherein said control means controls said electric motor means such that time points at which said first valve and said second valve are opened, respectively, are so set as to substantially coincide with a time point at which said displacement member reaches said top dead center and that the rotation speed of said motor means is lowered during a predetermined period close to said time point at which said displacement member reaches said top dead center.

10. A cold accumulation type refrigerating machine according to claim 9, wherein said predetermined period corresponds to a coverage of 30° in phase angle when said one cycle is represented in terms of a phase angle of 360°.

11. A cold accumulation type refrigerating machine according to claim 1, wherein said control means controls the rotation speed of said electric motor means such that said displacement member moves linearly at a uniform speed from said top dead center thereof to a bottom dead center.

12. A cold accumulation type refrigerating machine according to claim 11, wherein said control means further controls the rotation speed of said electric motor means such that said displacement member moves linearly at a uniform speed from said bottom dead center to said top dead center.

13. A cold accumulation type refrigerating machine according to claim 1, wherein said control means controls the rotation speed of said electric motor means such that a time taken for said displacement member to move from a bottom dead center to said top dead center is longer than a time taken for said displacement member to move from the top dead center to the bottom dead center.

14. A cold accumulation type refrigerating machine, comprising:

electric motor means having a rotatable output shaft;

means for converting a rotation of said output shaft into a linear reciprocative motion of a displacement member disposed within a stationary cylinder;

a hermetically closed gas expansion chamber defined within said cylinder and having a volume variable as said displacement member moves reciprocatively;

a gas compressor having an outlet port communicated to said closed chamber through a first valve and a cold accumulator for feeding a compressed gas discharged from said gas compressor to said closed chamber through said cold accumulator when said first valve is opened, said gas being caused to expand within said closed chamber, a second valve being provided in communication with said closed chamber so that said gas which has undergone the expansion within said closed chamber is fed back to said gas compressor through said cold accumulator when said second valve is opened, wherein feed of said compressed gas to said closed chamber, expansion thereof within said closed chamber and feeding back of said gas to said compressor after expansion constitute one cycle of operation of said refrigerating machine;

temperature sensor means for detecting a temperature of a heat conducting portion provided at a bottom of said cylinder; and control means for changing a rotation speed of said electric motor means during said one cycle of operation in dependence on a temperature level of said heat conducting portion detected by said temperature sensor means;

wherein:

said control means controls the rotation speed of said motor such that said rotation speed of said motor is low during a period extending from a time point at which said second valve is opened to a time point at which said displacement member reaches a top dead center while increasing said rotation speed during the remaining period of said operation cycle, when an output of said temperature sensor indicates a relative high temperature, while when the output of said temperature sensor indicates a relatively low temperature, said control means controls the rotation speed of said electric motor means such that said displacement member moves linearly at a uniform speed from a top dead center thereof to a bottom dead center and from the bottom dead center to the top dead center.

15. A cold accumulation type refrigerating machine, comprising:

first electric motor means having a rotatable output shaft;

first means for converting a rotation of said output shaft into a linear reciprocative motion of a first displacement member disposed within a first stationary cylinder;

a first gas expansion chamber defined within said first cylinder below said first displacement member and having a volume variable as said first displacement member moves reciprocatively;

a first cold accumulator disposed externally of said first cylinder in fluid communication with a top chamber defined above said displacement member and said first gas expansion chamber;

second electric motor means having a rotatable output shaft;

second means for converting the rotation of said output shaft into a linear reciprocative motion of a second displacement member disposed within a second stationary cylinder disposed downstream of said first cylinder and having a greater volume than that of said first cylinder, said second cylinder having a top chamber defined above said second displacement member and communicated to the top chamber of said first cylinder;

a second gas expansion chamber defined within said second cylinder and having a volume variable as said second displacement member moves reciprocatively;

a second cold accumulator disposed externally of said second cylinder in fluid communication with said first and second gas expansion chambers;

a gas compressor having an outlet port communicated to said first and second gas expansion chambers through a first valve and said first and second cold accumulators for feeding a compressed gas discharged from said gas compressor to said first and second gas expansion chambers through said first and second cold accumulators, respectively, when said first valve is opened, said gas being caused to expand within said first and second gas expansion chambers, said gas compressor having a second valve communicated to said first and second gas expansion chambers so that said gas which has undergone the expansion within said closed chamber is fed back to said gas compressor through said first and second cold accumulators when said second valve is opened;

first and second sensor temperature sensors disposed at bottoms of said first and second cylinders, respectively; and control means for controlling rotation speeds of said first and second motors in dependence on outputs of said first and second temperature sensors such that said rotation speed of said first motor is low during a period extending from a time point at which said second valve is opened to a time point at which said first displacement member reaches a top dead center while increasing said rotation speed during the remaining period of said operation cycle, while controlling the rotation speed of said second electric motor means such that said second displacement member moves linearly at a uniform speed from a top dead center thereof to a bottom dead center and from the bottom dead center to the top dead center.

16. A cold accumulation type refrigerating machine, comprising:

electric motor means having a rotatable output shaft;

means for converting a rotation of said output shaft into a linear reciprocative motion of a displacement member disposed within a stationary cylinder;

a hermetically closed gas expansion chamber defined within said cylinder and having a volume variable as said displacement member moves reciprocatively;

a gas compressor having an outlet port communicated to said gas expansion chamber through a first valve and a cold accumulator for feeding a compressed gas discharged from said gas compressor to said gas expansion chamber by way of said cold accumulator when said first valve is opened, said gas being caused to expand within said closed chamber, a second valve being provided in communication with said closed chamber so that said gas which has undergone the expansion within said gas expansion chamber is fed back to said gas compressor through said cold accumulator when said second valve is opened, wherein feeding of said compressed gas to said closed chamber, expansion thereof within said closed chamber and feeding back of said gas to said compressor after expansion constitute one cycle of operation of said refrigerating machine;

pressure sensor means for measuring a pressure within said cylinder;

temperature sensor means for detecting a temperature of a heat conducting portion provided at a bottom end of said cylinder; and control means for determining arithmetically a rate of the gas flow into said gas expansion chamber on the basis of outputs of said pressure sensor and said temperature sensor to thereby change a rotation speed of said electric motor means during said one cycle of operation so that said gas flow rate remains substantially constant over said one cycle of operation.

17. A cold accumulation type refrigerating machine according to claim 16, wherein said gas flow rate is computed in accordance with $$F=d(\rho V)/dt$$

where F represents said gas flow rate, $\rho$ represents a gas density within said gas expansion chamber and V represents a volume of said gas expansion chamber.

18. A cold accumulation type refrigerating machine according to claim 16, wherein said pressure sensor is adapted to detect pressure within said gas expansion chamber.

19. A cold accumulation type refrigerating machine according to claim 16, wherein said pressure sensor is adapted to detect pressure within a top chamber defined above said displacement member.

* * * * *